US009759039B1

(12) United States Patent
Hardesty

(10) Patent No.: US 9,759,039 B1
(45) **Date of Patent: *Sep. 12, 2017**

(54) DEGRADABLE MATERIAL TIME DELAY SYSTEM AND METHOD

(71) Applicant: GEODynamics, Inc., Millsap, TX (US)

(72) Inventor: John T Hardesty, Weatherford, TX (US)

(73) Assignee: GEODYNAMICS, INC., Millsap, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/090,963

(22) Filed: Apr. 5, 2016

Related U.S. Application Data

(63) Continuation-in-part of application No. 15/053,417, filed on Feb. 25, 2016, and a continuation-in-part of application No. 15/053,534, filed on Feb. 25, 2016.

(51) Int. Cl.
*E21B 34/06* (2006.01)
*E21B 33/13* (2006.01)
*E21B 33/12* (2006.01)

(52) U.S. Cl.
CPC ..... *E21B 34/063* (2013.01); *E21B 33/1208* (2013.01); *E21B 33/13* (2013.01)

(58) Field of Classification Search
CPC ..... E21B 34/063; E21B 33/13; E21B 33/1208
See application file for complete search history.

(56) References Cited

U.S. PATENT DOCUMENTS 3,010,515 A 11/1961 Harrison
3,022,822 A * 2/1962 Loy, III et al. ..... E21B 23/08 166/153
4,429,741 A 2/1984 Hyland
4,614,156 A * 9/1986 Colle, Jr. ..... E21B 43/116 102/275.11
5,115,865 A * 5/1992 Carisella ..... F42D 1/04 166/297
6,176,323 B1 1/2001 Weirich
8,579,036 B2 11/2013 Xu
2001/0054514 A1 12/2001 Sullivan et al.
(Continued)

OTHER PUBLICATIONS

TC-Hookups-0.5, Owen Oil Tools—Core Laboratories, Nov. 2007, Revision 2, 15 pages.
(Continued)

*Primary Examiner* — David Andrews
(74) *Attorney, Agent, or Firm* — David W. Carstens; Sudhakar V. Allada; Carstens & Cahoon, LLP

(57) ABSTRACT

A detonating restriction plug element and method in a wellbore casing. The element includes a hollow passage in the restriction plug element that receives a detonating assembly coupled to a mechanical restraining element, and a space for containing a reactive fluid. The mechanical restraining element undergoes a change in shape for a pre-determined time delay due to a chemical reaction when the reactive fluid in the space such as wellbore fluids comes in contact with the restraining element. A firing pin in the detonating assembly is released when the restraining elements changes shape and releases the restraint on the firing pin. The firing pin contacts a detonator in the detonating assembly and causes a detonating event such that the restriction plug element fragments.

28 Claims, 26 Drawing Sheets

(56) References Cited

U.S. PATENT DOCUMENTS

| | | | | |
|---|---|---|---|---|
| 2008/0066923 | A1 | 3/2008 | Xu | |
| 2010/0108311 | A1 | 5/2010 | Daussin | |
| 2010/0270031 | A1* | 10/2010 | Patel | E21B 33/1208 166/376 |
| 2011/0132608 | A1 | 6/2011 | Busaidy et al. | |
| 2014/0096970 | A1 | 4/2014 | Andrew et al. | |
| 2015/0247084 | A1 | 9/2015 | Epstein | |
| 2015/0275616 | A1 | 10/2015 | Epstein | |
| 2016/0047193 | A1 | 2/2016 | Snider et al. | |

OTHER PUBLICATIONS

ISA/US, International Search Report and Written Opinion for PCT/US2017/014622 mailed Apr. 4, 2017.

ISA/US, International Search Report and Written Opinion for PCT/US2017/014613 mailed Apr. 4, 2017.

U.S. Appl. No, 15/053,417, filed Feb. 25, 2016, entitled "Degradable Material Time Delay System and Method."

U.S. Appl. No. 15/220,042, filed Jul. 26, 2016, entitled "Degradable Material Time Delay System and Method."

* cited by examiner

DEGRADABLE MATERIAL TIME DELAY SYSTEM AND METHOD

CROSS REFERENCE TO RELATED APPLICATIONS

This application is a continuation-in-part of U.S. application Ser. Nos. 15/053,417 and 15/053,534, both filed Feb. 25, 2016, the disclosures of which are fully incorporated herein by reference.

FIELD OF THE INVENTION

The present invention generally relates to restriction plug elements in a wellbore. Specifically, the invention attempts to utilize a reactive fluid that reacts with a degradable mechanical element for a known time delay and initiates a detonating event inside a restriction plug element.

PRIOR ART AND BACKGROUND OF THE INVENTION

Prior Art Background

In oil and gas extraction applications, there is a need to have a certain length of time delay between pressure triggered events such that the system can be tested at a pressure before the next event could proceed. This system cannot be controlled with any other means besides the application of pressure. Prior art system means of fluid restriction uses a complex system of microscopic passages that meter fluid. Therefore, there is a need for non-expensive simple and flexible component flow restriction systems.

Inside a tandem in a gun string assembly, a transfer happens between the detonating cords to detonate the next gun in the daisy chained gun string. Detonation can be initiated from the wireline used to deploy the gun string assembly either electrically, by pressure activation or by electronic means. In tubing conveyed perforating (TCP) as there is no electric conductor, pressure activated percussion initiation is used to detonate. TCP is used to pump up to a tubing pressure that reaches a certain pressure enabling a firing head to launch a firing pin. Subsequently, the firing pin starts the percussion initiator which starts the detonation cord. There is a need to delay the launching of a firing pin by a predetermined time in certain instances so that tests can be conducted or a hang fire condition may be detected on a previous gun.

In tandem systems there is a single detonating cord passing through the guns. There are no pressure barriers. However, in select fire systems (SFS) there is a pressure isolation switch between each gun. Each gun is selectively fired though its own detonation train. A detonator feeds off each switch. When the lower most perforating gun is perforated, pressure enters the inside of the gun. When the first gun is actuated, the second detonator gets armed when the pressure in the first gun switch moves into the next position actuating a firing pin to enable detonation in the next gun. All guns downstream are isolated from the next gun by the pressure barrier.

Spool valves are directional control valves that are used as wellbore tools. They allow fluid flow into different paths from one or more sources. They usually consist of a spool inside a cylinder which is mechanically or electrically controlled. The movement of the spool restricts or permits the flow, thus it controls the fluid flow. There are two fundamental positions of directional control valve namely normal position where valve returns on removal of actuating force and other is working position which is position of a valve when actuating force is applied. However, prior art spool valves do not have a control mechanism with a pre-determined delay to switch from normal position to a working position.

It is known that well fluids vary in the chemical nature and are not always the same composition. However, the temperature of the well is often defined or can be manipulated to achieve a pre-determined temperature. Most time delay elements currently used comprise complex mechanisms and are often expensive. Therefore, there is a need for a time delay tool that can use a known fluid or an unknown fluid inside a well at a known temperature such that a known degradable element can react and degrade in the known fluid at the known temperature for a known amount of time so that a pre-determined time may be achieved to trigger a mechanism in a device.

In many instances a single wellbore may traverse multiple hydrocarbon formations that are otherwise isolated from one another within the Earth. It is also frequently desired to treat such hydrocarbon bearing formations with pressurized treatment fluids prior to producing from those formations. In order to ensure that a proper treatment is performed on a desired formation, that formation is typically isolated during treatment from other formations traversed by the wellbore. To achieve sequential treatment of multiple formations, the casing adjacent to the toe of a horizontal, vertical, or deviated wellbore is first perforated while the other portions of the casing are left unperforated. The perforated zone is then treated by pumping fluid under pressure into that zone through perforations. Following treatment a plug is placed adjacent to the perforated zone. The process is repeated until all the zones are perforated. The plugs are particularly useful in accomplishing operations such as isolating perforations in one portion of a well from perforations in another portion or for isolating the bottom of a well from a wellhead. The purpose of the plug is to isolate some portion of the well from another portion of the well.

Subsequently, production of hydrocarbons from these zones requires that the sequentially set plugs be removed from the well. In order to reestablish flow past the existing plugs an operator must remove and/or destroy the plugs by milling, drilling, or dissolving the plugs.

Additionally, frac plugs can be inadvertently set at undesired locations in the wellbore casing creating unwanted constrictions. The constrictions may latch wellbore tools that are run for future operations and cause unwanted removal process. Therefore, there is a need to prevent premature set conditions caused by conventional frac plugs.

The steps comprised of setting up a plug, isolating a hydraulic fracturing zone, perforating the hydraulic fracturing zone and pumping hydraulic fracturing fluids into the perforations are repeated until all hydraulic fracturing zones in the wellbore casing are processed. When all hydraulic fracturing zones are processed, the plugs are milled out with a milling tool and the resulting debris is pumped out or removed from the wellbore casing. Hydrocarbons are produced by pumping out from the hydraulic fracturing stages.

The milling step requires that removal/milling equipment be run into the well on a conveyance string which may typically be wire line, coiled tubing or jointed pipe. The process of perforating and plug setting steps represent a separate "trip" into and out of the wellbore with the required equipment. Each trip is time consuming and expensive. In addition, the process of drilling and milling the plugs creates debris that needs to be removed in another operation.

Therefore, there is a need for isolating multiple hydraulic fracturing zones without the need for a milling operation. Furthermore, there is a need for positioning restrictive plug elements that could be removed in a feasible, economic, and timely manner before producing gas.

Deficiencies in the Prior Art

The prior art as detailed above suffers from the following deficiencies:

- Prior art systems do not provide for a known degradable element that can react and degrade in a known fluid at a known temperature for a known amount of time so that a pre-determined time may be achieved to trigger a mechanism in a device.
- Prior art systems do not provide for a low cost configurable time delay flow restriction element that is commonly available.
- Prior art systems do not provide for a predictable time delay.
- Prior art systems do not provide for a cost effective time delay solution that are independent of the wellbore fluids.
- Prior art systems require bulky and expensive hydraulics.
- Prior art systems require expensive electronics that have difficulty functioning at downhole temperatures.
- Prior art systems do not provide for isolating multiple hydraulic fracturing zones without the need for a milling operation.
- Prior art systems do not provide for positioning restrictive elements that could be removed in a feasible, economic, and timely manner.
- Prior art systems cause undesired premature preset conditions preventing further wellbore operations.

While some of the prior art may teach some solutions to several of these problems, the core issue of a predictable time delay with known fluids at pre-determined temperatures has not been addressed by prior art.

BRIEF SUMMARY OF THE INVENTION

System Overview

The present invention in various embodiments addresses one or more of the above objectives in the following manner. A detonating restriction plug element wellbore casing includes a hollow passage in the restriction plug element that receives a detonating assembly coupled to a mechanical restraining element, and a space for containing a reactive fluid. The mechanical restraining element undergoes a change in shape for a pre-determined time delay due to a chemical reaction when the reactive fluid in the space such as wellbore fluids comes in contact with the restraining element. A firing pin in the detonating assembly is released when the restraining elements changes shape and releases the restraint on the firing pin. The firing pin contacts a detonator in the detonating assembly and causes a detonating event such that the restriction plug element fragments. The amount of the pre-determined time delay is determined by factors that include the reactive fluids, concentration of the reactive fluids, geometry and size of the mechanical restraining element.

Method Overview

The present invention system may be utilized in the context of an overall detonating method, wherein the detonating restriction plug element as previously described is controlled by a method having the following steps:

(1) deploying the restriction plug element into the wellbore casing and isolating a stage to block fluid communication;
(2) fracturing the stage;
(3) initiating a chemical reaction between the mechanical restraining element and the reactive fluid;
(4) progressing the chemical reaction for a pre-determined time delay and changing a physical property of the mechanical restraining element;
(5) releasing the firing pin after elapse of the time delay; and
(6) initiating a detonating event.

Integration of this and other preferred exemplary embodiment methods in conjunction with a variety of preferred exemplary embodiment systems described herein in anticipation by the overall scope of the present invention.

BRIEF DESCRIPTION OF THE DRAWINGS

For a fuller understanding of the advantages provided by the invention, reference should be made to the following detailed description together with the accompanying drawings wherein.

OBJECTIVES OF THE INVENTION

Figure 1:
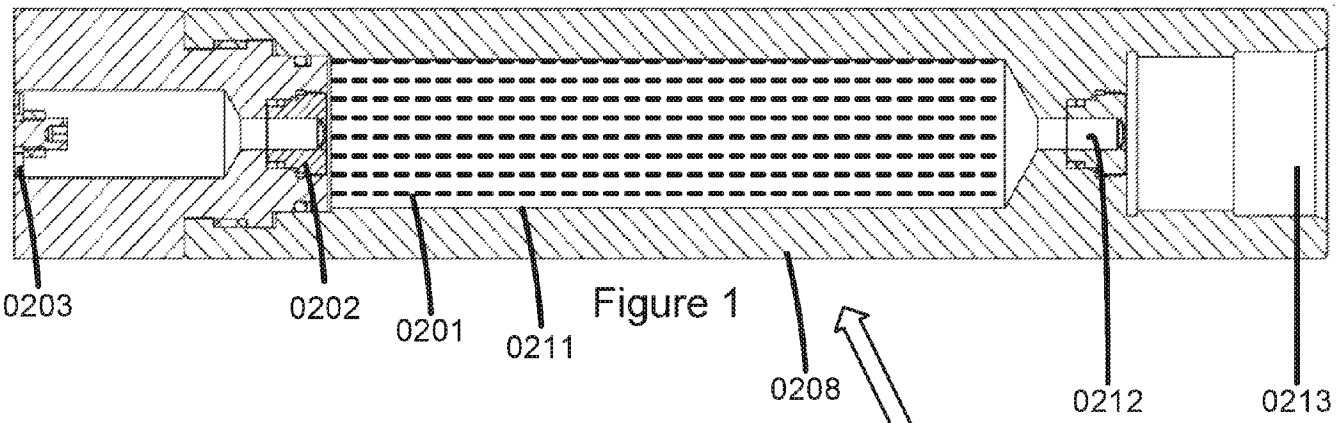
FIG. 1 illustrates a cross-section overview diagram of downhole wellbore time delay tool according to an exemplary embodiment of the present invention.

Accordingly, the objectives of the present invention are (among others) to circumvent the deficiencies in the prior art and affect the following objectives:

- Provide for a known degradable element that can react and degrade in a known fluid at a known temperature for a known amount of time so that a pre-determined time may be achieved to trigger a mechanism in a device.
- Provide for a low cost configurable time delay flow restriction element that is commonly available.
- Provide for a predictable time delay.
- Provide for a cost effective time delay solution that is independent of the wellbore fluids.
- Provide for a tubing conveyed perforating gun with a delay mechanism which provides a known delay interval between pressuring the tubing to a second predetermined level and the actual firing of the perforating gun.
- Provide for a delay means to move a firing pin holder out of locking engagement with a firing pin, to release firing pin, after a predetermined time interval.
- Provide for portable and inexpensive hydraulics for a time delay tool.
- Provide for an inexpensive time delay tool that functions reliably at downhole temperatures.
- Provide for a time delay tool suitable for wireline conveyed, coil tubing conveyed, casing conveyed or pump down.
- Provide for isolating multiple hydraulic fracturing zones without the need for a milling operation.
- Provide for positioning restrictive elements that could be removed in a feasible, economic, and timely manner.
- Provide for tools that prevent undesired premature preset conditions that hinder further wellbore operations.

While these objectives should not be understood to limit the teachings of the present invention, in general these objectives are achieved in part or in whole by the disclosed invention that is discussed in the following sections. One skilled in the art will no doubt be able to select aspects of the present invention as disclosed to affect any combination of the objectives described above.

DESCRIPTION OF THE PRESENTLY PREFERRED EXEMPLARY EMBODIMENTS

While this invention is susceptible of embodiment in many different forms, there is shown in the drawings and will herein be described in detailed preferred embodiment of the invention with the understanding that the present disclosure is to be considered as an exemplification of the principles of the invention and is not intended to limit the broad aspect of the invention to the embodiment illustrated.

The numerous innovative teachings of the present application will be described with particular reference to the presently preferred embodiment, wherein these innovative teachings are advantageously applied to the particular problems of a hydraulic time delay system and method. However, it should be understood that this embodiment is only one example of the many advantageous uses of the innovative teachings herein. In general, statements made in the specification of the present application do not necessarily limit any of the various claimed inventions. Moreover, some statements may apply to some inventive features but not to others.

Preferred Exemplary Downhole Wellbore Time Delay Tool Integrated into an Energetic Device (0200-0600)

Figure 2:
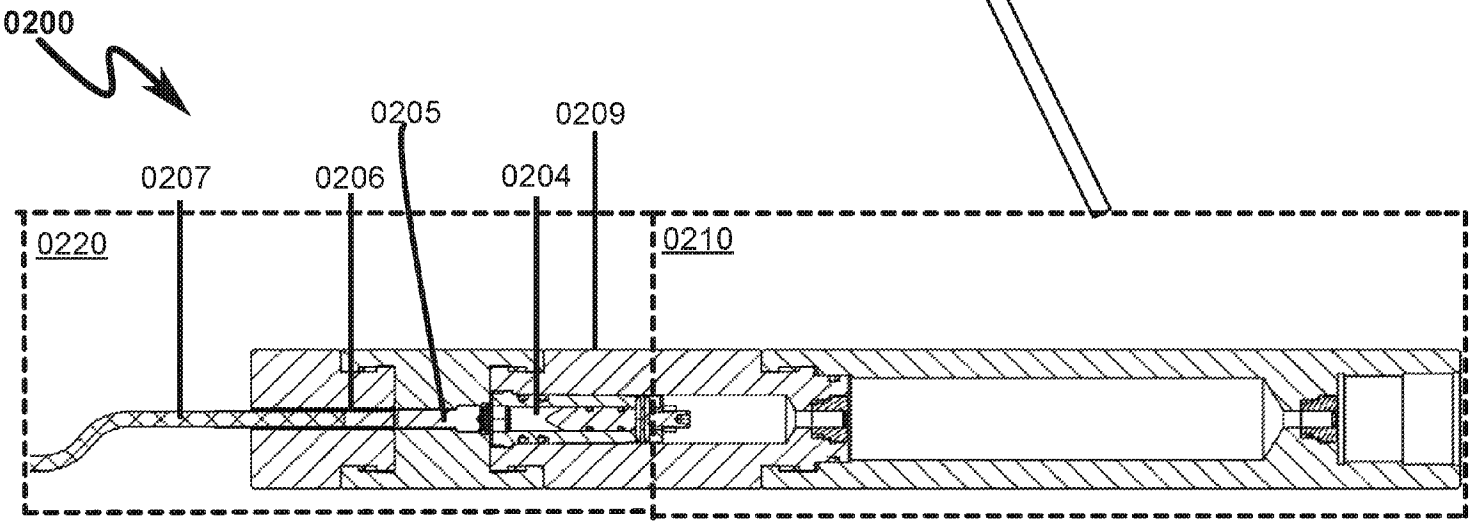
FIG. 2 illustrates a cross-section overview diagram of downhole wellbore time delay tool with an energetic device and a firing pin according to an exemplary embodiment of the present invention.

As generally illustrated in FIG. 1 and FIG. 2 (0200), a downhole wellbore time delay tool (0210) for use in a wellbore casing comprises a reservoir (0211) for containing a reactive fluid (0201), an actuating device (0202) such as a rupture disk, a mechanical restraining element (0203) such as a nut and mechanically connected to a wellbore device such as an energetic device (0220) with firing pin (0204), a percussion initiator (0205), a booster (0206) and a detonating cord (0207). A detailed view of the wellbore tool (0210) is illustrated in FIG. 1. The entire tool (0200) may be piped into the casing string as an integral part of the string and positioned where functioning of the tool is desired or the tool may be deployed to the desired location with TCP, CT or a wire line. The wellbore may be cemented or not. The fluid in the reservoir (0211) is held at an initial position by the actuating device (0202), such as a rupture disk. The tool mandrel is machined to accept the actuating device (0202) (such as rupture discs) that ultimately controls the flow of reactive fluid (0201). The fluid reservoir (0211) may be further installed in within a fluid holding body (0208). The fluid holding body (0208) may be operatively connected to a body (0209) of the energetic device (0220). In one embodiment, the rated pressure of the actuating device may range from 500 PSI to 15000 PSI.

The reservoir (0211) may be in fluid communication with the mechanical restraining element via the actuation device (0202). Alternatively, the reactive fluid may be directly in fluid communication with the mechanical restraining element via the actuation device (0202) without a reservoir. For example, the mechanical restraining element may not be in fluid communication initially with any fluid. When the pressure in the wellbore casing increases to actuate the actuating device, wellbore fluids may enter and react with the mechanical restraining element. It should be noted that the reservoir to contain a reactive fluid may not be construed as a limitation. A pressure port (0213) may be attached to another end of the reservoir through another actuating device (0212). The reservoir (0211) may be a holding tank that may be positioned inside a fluid holding body (0208) of a well casing. The volume of the reservoir may range from 25 ml to 5 liters. The material of the reservoir may be chosen so that the reactive fluid inside the reservoir does not react with the material of the reservoir and therefore does not corrode or erode the reservoir (0211). According to a preferred exemplary embodiment, the material of the reservoir may be selected from a group comprising: metal, ceramic, plastic, degradable, long term degradable, glass, composite or combinations thereof. The reservoir may also be pressurized so that there is sufficient flow of the reactive fluid towards the restraining element. The actuation device (0202) may be a reverse acting rupture disk that blocks fluids communication between the reactive fluid and the restraining element. The actuation device (0212) ruptures or actuates when a pressure in the wellbore through the pressure port (0213) exceeds a rated pressure of the actuating device (0212). After the actuating device (0212) rupture, the pressure acting through the pressure port (0213) may act on the fluid which further acts on the actuating device (0202). When the pressure of the fluid acting on the actuation device (0202) exceeds a rated pressure of the actuating device (0202), the reactive fluid (0201) flows through and enters a chamber and comes in contact with the restraining element (0203). According to another preferred exemplary embodiment the actuating device is an electronic switch that is actuated by a signal from a device storing a stored energy.

The pressure on the actuation device (0202) may be ramped up to the rated pressure with pressure from the reactive fluid. The reactive fluid (0201) is configured to react with the mechanical restraining element (0203) at a temperature expected to be encountered in the wellbore. According to a preferred exemplary embodiment a physical property change in the restraining element may occur at a pre-determined temperature expected to be encountered in the wellbore casing. According to a further preferred exemplary embodiment the pre-determined temperature ranges from 25° C.-250° C. The mechanical restraining element (0203) may be a nut, a shear pin, or a holding device that degrades as the reaction takes place. Upon further degradation, the mechanical restraining element (0203) may release a restraint on the energetic device (0220) and enable the entire pressure or stored energy to act on an end of the energetic device (0220).

According to a preferred exemplary embodiment the reactive fluid is selected from a group comprising: fresh water, salt water, KCL, NaCl, HCL, or hydrocarbons.

The energetic device (0220) may be operatively connected to the mechanical restraining element via threads, seals or a connecting element. The tool mandrel may be machined to accept the wellbore reservoir, the actuating device and the wellbore device such as a firing pin assembly. In some instances, the mechanical restraining element may be a nut that may be screwed or attached to a counterpart in the wellbore device. In other instances the restraining element may be a tensile member. The wellbore device may be an energetic device (0220) with a firing pin (0204) as illustrated in FIG. 2 (0200).

According to a preferred exemplary embodiment, when a stored energy, such as a pressure from a fluid, is applied on the firing pin assembly, the actuating device (0202) is actuated and the reactive fluid (0201) from the reservoir (0211) comes into contact with the mechanical restraining element (0203) and enables a physical property change in the mechanical restraining element such that the stored energy applied on the wellbore device is delayed by a pre-determined time delay while the mechanical restraining element undergoes the physical property change. The physical property change may enable the restraining element to change shape for a pre-determined period of time. The physical property may be strength, ductility or elasticity. In tubing conveyed perforating gun with a delay mechanism, a known delay interval between pressuring the tubing to a second pre-determined level and the actual firing of the perforating gun may be achieved by the pre-determined time delay. In a select fire system, a delay means, to move a firing pin holder out of locking engagement with a firing pin to release the firing pin, may be achieved by the predetermined time interval. 5. The firing pin (0204) may contact a percussion detonator/initiator (0205) that connects to a bidirectional booster (0206). The bidirectional booster (0206) may accept a detonation input from the detonator. The detonating cord (0207) may be initiated in turn by the booster (0206). When the firing pin is actuated after the mechanical restraint (0203) is released, the firing pin (0204) may contact a percussion detonator (0205) and in turn initiate a detonator through a booster (0206) and a detonating cord (0207).

According to a preferred exemplary embodiment, the stored energy is applied from a spring. According to another preferred exemplary embodiment, the stored energy is applied from a pressure from a fluid and a seal. According to a further preferred exemplary embodiment, the stored energy is applied from a magnetic field. According to yet another preferred exemplary embodiment, the stored energy is applied from a weight.

According to a preferred exemplary embodiment, the pre-determined time delay ranges from 1 hour to 48 hours. According to a more preferred exemplary embodiment, the pre-determined time delay ranges from 2 days to 14 days. According to a most preferred exemplary embodiment, the pre-determined time delay ranges from 0.01 seconds to 1 hour.

According to a preferred exemplary embodiment, the chemical reaction may be an exothermic reaction that gives off heat. The energy needed to initiate the chemical reaction may be less than the energy that is subsequently released by the chemical reaction. According to another preferred exemplary embodiment, the chemical reaction may be an endothermic reaction that absorbs heat. The energy needed to initiate the chemical reaction may be greater than the energy that is subsequently released by the chemical reaction.

The rate of the chemical reaction may be accelerated or retarded based on factors such as nature of the reactants, particle size of the reactants, concentration of the reactants, pressure of the reactants, temperature and catalysts. According to a preferred exemplary embodiment, a catalyst may be added to alter the rate of the reaction. According to a preferred exemplary embodiment, the material of the restraining element may be selected from a group comprising: mixture of aluminum, copper sulfate, potassium chlorate, and calcium sulfate, iron, magnesium, steel, plastic, degradable, magnesium-iron alloy, particulate oxide of an alkali or alkaline earth metal and a solid, particulate acid or strongly acid salt, or mixtures thereof. The catalyst may be selected from a group comprising salts. According to a preferred exemplary embodiment, the material of the restraining element may be selected from a group comprising: metal, non-metal or alloy.

According to a preferred exemplary embodiment the mechanical restraining element is a restrictive plug element. For example, the restriction plug element may be a ball or a plug that is used to isolate pressure communication between zones or stages in a well casing.

According to a preferred exemplary embodiment the pre-determined time delay is determined by concentration of the reactive fluids. According to another preferred exemplary embodiment the pre-determined time delay is determined by reaction rate of the reactive fluids with the mechanical restraining element. According to yet another preferred exemplary embodiment the pre-determined time delay is determined by reaction time of the reactive fluids with the mechanical restraining element. According to a further preferred exemplary embodiment the pre-determined time delay is determined by masking a contact area of the mechanical restraining element. According to a further preferred exemplary embodiment the pre-determined time delay is determined by masking a total area of the mechanical restraining element in contact with the mechanical restraining element.

According to a preferred exemplary embodiment the shape of the mechanical restraining element is selected from a group comprising: square, circle, oval, and elongated.

A sealed cap may seal the exposed end of the reservoir to physically protect the reservoir from undesired wellbore conditions.

According to an alternate preferred embodiment, a multi stage restraining element comprising a blocking member and a restraining member may further increase a time delay. For example, mechanical restraining element (0203) may be coupled with a blocking member that may have a different composition and reaction time with the fluid in the reservoir. The blocking member may react with the fluid for a period of time and may restrict fluid access to the mechanical restraining element for a pre-determined period of time. It should be noted that the multi stage restraining element may not limited to a blocking member and a restraining element. Any number of blocking members and restraining elements may be used in combination to achieve a desired time delay. The reaction times and therefore the time delays of each of the bonding members with the fluid may be characterized at various temperatures expected in the wellbore.

In another preferred exemplary embodiment, the reservoir may be filled with wellbore fluids. For example, the reservoir may be empty when deployed into the wellbore and later filled with wellbore fluids. A time vs temperature chart for the restraining element may be characterized with different compositions of wellbore fluids expected in the wellbore at temperatures expected in the wellbore casing. Alternatively, the fluid reservoir may be partially filled with the known fluid and wellbore fluids may fill the remaining portion of the reservoir. The reservoir may be filled with the known fluid, wellbore fluids or a combination thereof. The mechanical restraining element may comprise one or more material types that react and have different degradation rates in one or more fluid types. The desired time delay may be achieved with a combination of fluid types and restraining element material types.

Figure 3A:
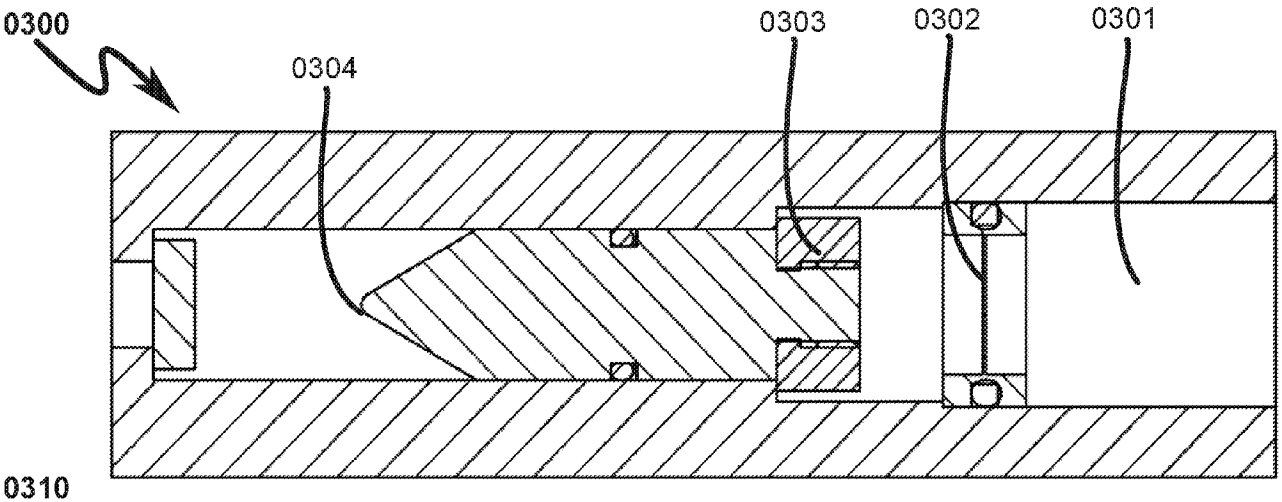
FIG. 3A-3D illustrates a cross-section view of downhole wellbore time delay tool with an energetic device and a firing pin describing an initial set up, actuation position, a degradation position, and a triggering position according to an exemplary embodiment of the present invention.
Figure 3B:
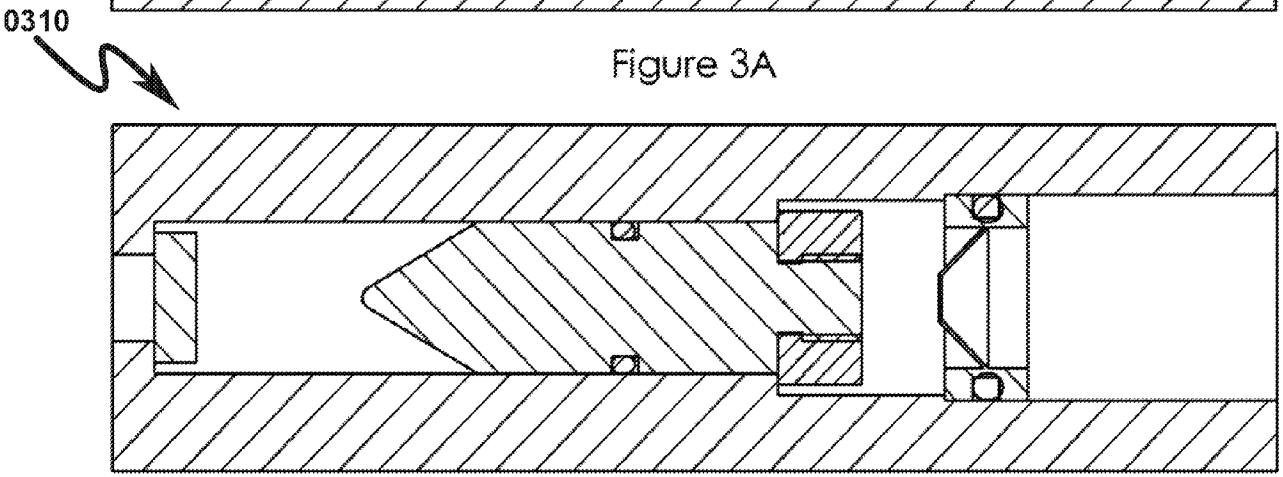
Figure 3C:
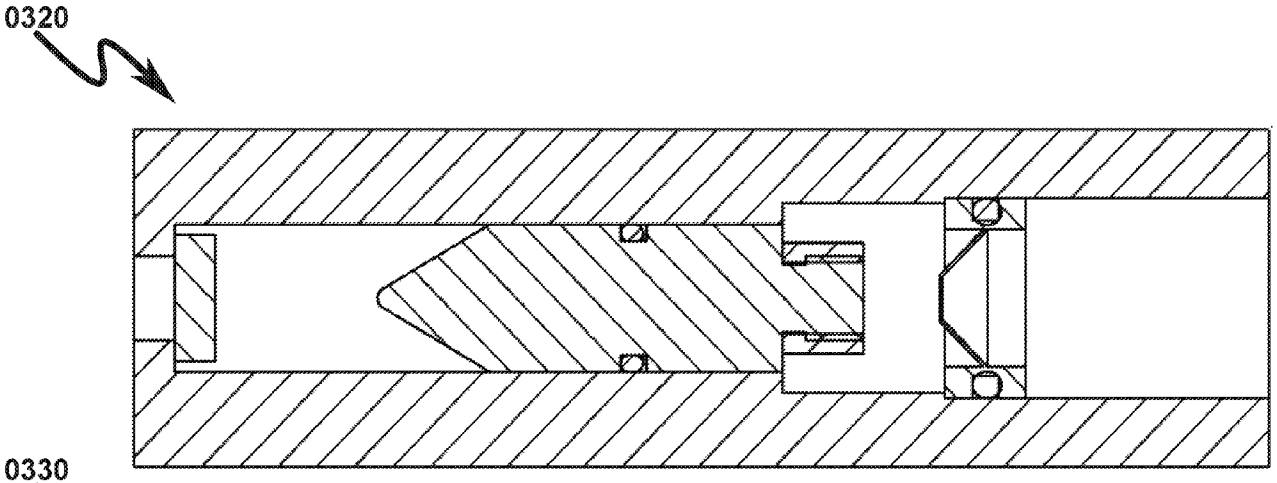
Figure 3D:
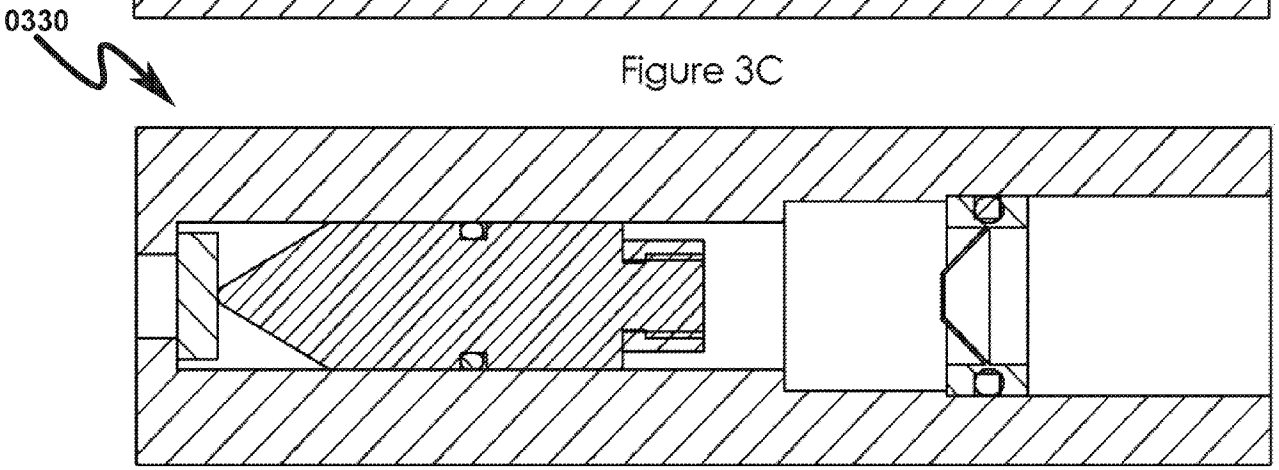

The present exemplary embodiment is generally illustrated in more detail in FIG. 3A (0300), FIG. 3B (0310), FIG. 3C (0320), FIG. 3D (0330), wherein the downhole wellbore delay tool is deployed inside a wellbore casing. FIG. 3A-3D generally illustrates different positions of a firing pin assembly (0304). The positions include an initial set up position (0300), an actuation position (0310), a degradation position (0320) and a triggering position (0330). The entire tool may be piped into the casing string as an integral part of the string and positioned where functioning of the tool is desired. In one exemplary embodiment, the tool may be a firing pin assembly that is positioned where detonation, perforation of a formation and fluid injection into a formation is desired. The tool may be installed in either direction with no change in its function. A detailed view of the tool in the initial set up position is shown in FIG. 3 (0300) where in the fluid in the reservoir is held by the actuating device (0302). When ready to operate, the pressure is increased for example with TCP. The tool then moves to the actuation position (0310), when pressure acting on the actuating device (0302) exceeds its rated pressure, the actuation device ruptures and enables reactive fluid in the fluid reservoir (0301) to enter the adjacent chamber and contacts the restraining element. Subsequently, after elapse of a pre-determined time delay, the restraining element degrades or changes shape due to the chemical reaction as illustrated in the degradation position in FIG. 3C (0320). In the triggering position (0330), the firing pin (0304) in the energetic device is triggered as the restraining element (0303) no longer holds or restrains the firing pin (0304) due to change of shape or strength. The entire stored energy may be applied to move the firing pin and contact a bidirectional booster, after the pre-determined time delay in the degradation position. The stored energy may be applied by pressure and seal, magnetic field, a weight, a spring or combination thereof.

Figure 4A:
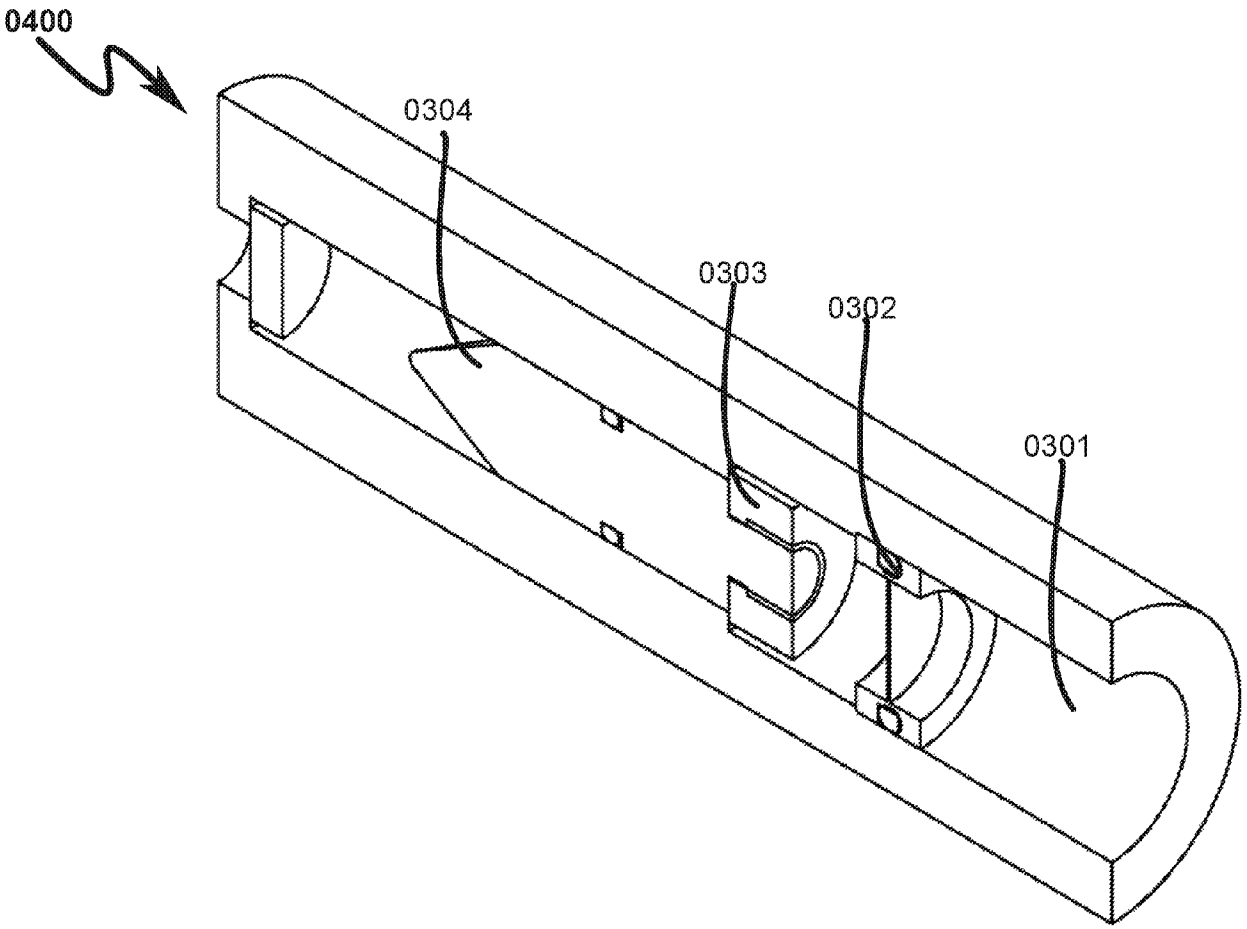
FIG. 4A illustrates a perspective view of a downhole wellbore time delay tool with an energetic device and a firing pin according to an exemplary embodiment of the present invention.

FIG. 4A (0400) generally illustrates a perspective view of the downhole delay tool with a firing pin as the wellbore device.

Figure 3E:
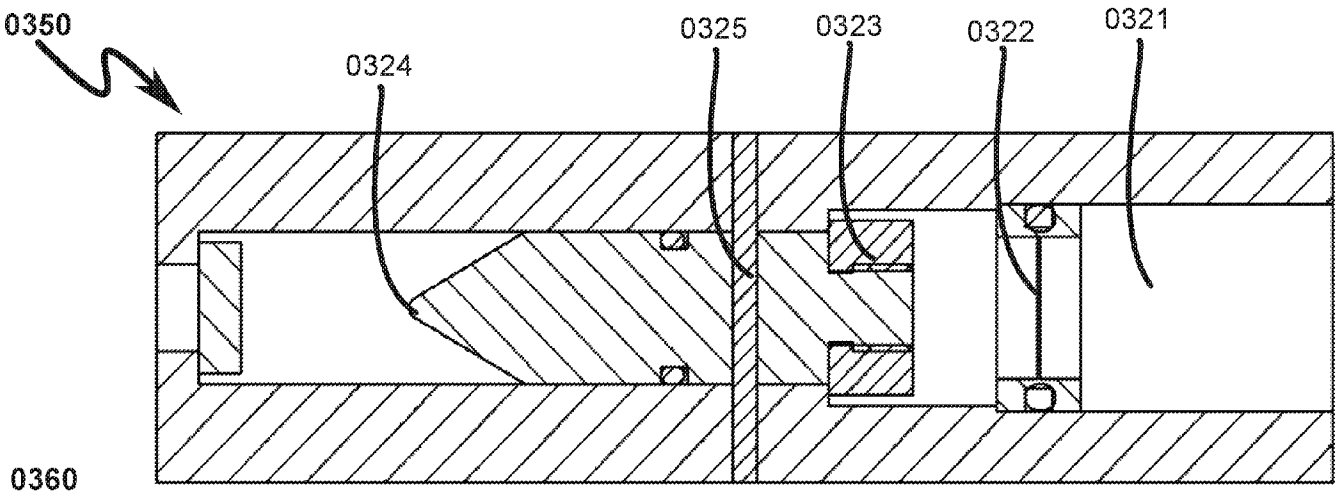
FIG. 3E-3H illustrates a cross-section view of downhole wellbore time delay tool with an energetic device and a firing pin with a shear pin restraint describing an initial set up, actuation position, a degradation position, and a triggering position according to an exemplary embodiment of the present invention.
Figure 3F:
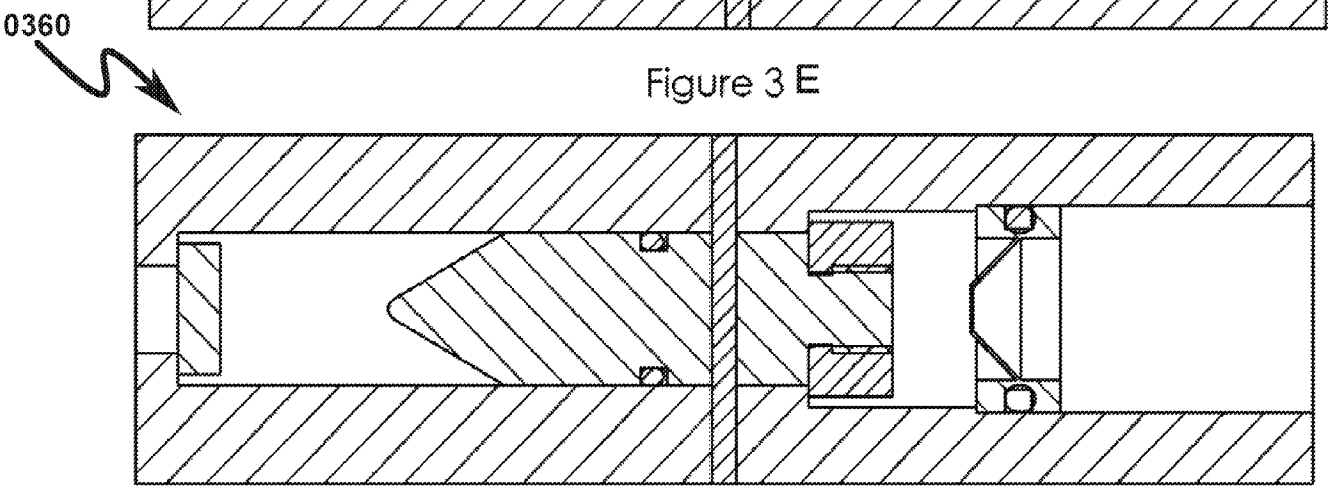
Figure 3G:
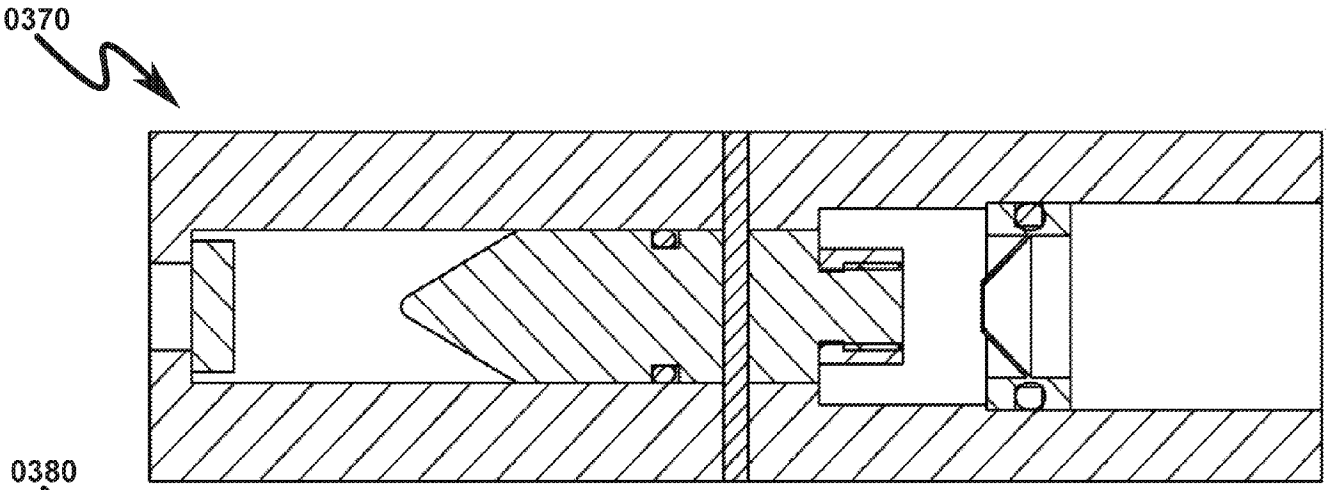
Figure 3H:
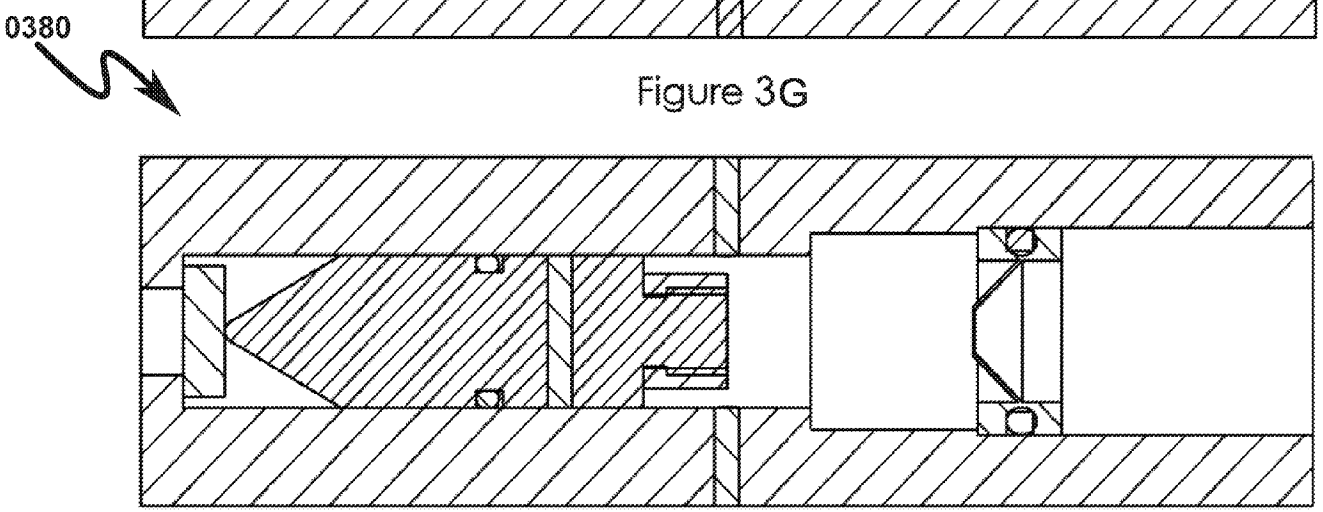
Figure 4B:
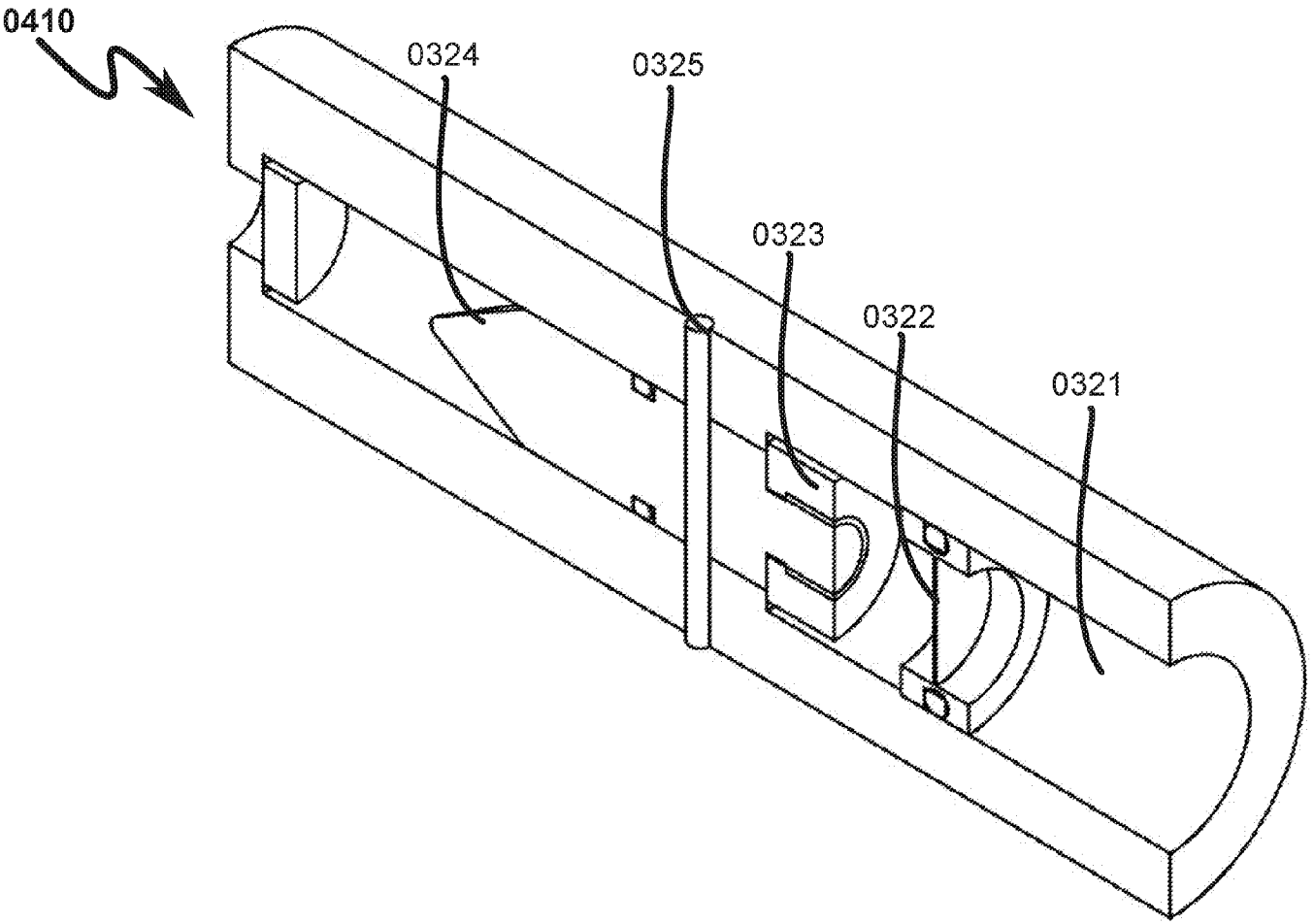
FIG. 4B illustrates a perspective view of a downhole wellbore time delay tool with an energetic device and a firing pin with a shear pin restraint according to an exemplary embodiment of the present invention.

Similar to FIGS. 3A-3D, a downhole delay tool with a firing pin and a shear pin restraint is generally illustrated in FIGS. 3E-3H. As generally illustrated in more detail in FIG. 3E (0350), FIG. 3F (0360), FIG. 3G (0370), FIG. 3H (0380), wherein the downhole wellbore delay tool is deployed inside a wellbore casing. FIG. 3E-3H generally illustrates different positions of a firing pin assembly (0324) restrained by a shear pin (0325) in addition to a mechanical restraining element (0323). The positions include an initial set up position (0350), an actuation position (0360), a degradation position (0370) and a triggering position (0380). A detailed view of the tool in the initial set up position is shown in FIG. 3E (0350) wherein the fluid in the reservoir is held by the actuating device (0322). When ready to operate, the pressure is increased for example with TCP. The tool then moves to the actuation position (0360), when pressure acting on the actuating device (0322) exceeds its rated pressure, the actuation device ruptures and enables reactive fluid in the fluid reservoir (0321) or well fluids from the wellbore casing to enter the adjacent chamber and contacts the restraining element. Subsequently, after elapse of a pre-determined time delay, the restraining element degrades or changes shape due to the chemical reaction as illustrated in the degradation position in FIG. 3G (0370). In the triggering position (0380), the firing pin (0324) in the energetic device is triggered as the restraining element (0323) no longer holds or restrains the firing pin (0324) and the shear pin (0325) due to change of shape or a physical property. According to a preferred exemplary embodiment, the shear pins provide additional control, when the time delay enables, but it would need an active input to finally fire. FIG. 4B (0410) generally illustrates a perspective view of the downhole delay tool with an energetic device and a firing pin and a shear pin restraint mechanism as the wellbore device. The mechanical restraining element (0323) could be degraded, releasing the shear pin (0325), and then the tool would have to be pumped to a pressure sufficient to shear the shear pins (0325), which would allow the firing pin (0324) to strike a percussion initiator (not shown).

Figure 5A:
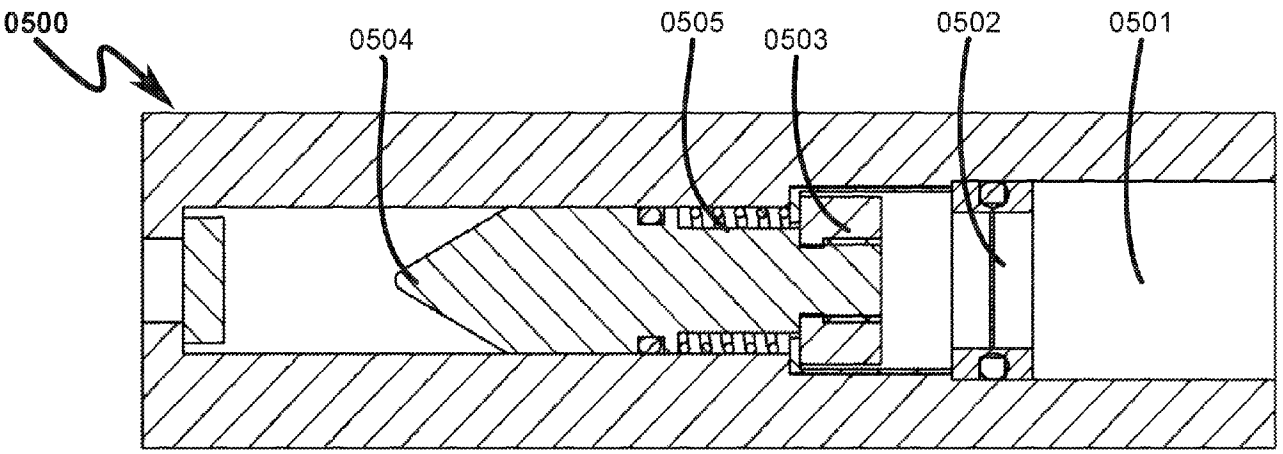
FIG. 5A-5D illustrates a cross-section view of downhole wellbore time delay tool with an energetic device and a firing pin and a spring loaded device describing an initial set up, actuation position, a degradation position, and a triggering positions according to an exemplary embodiment of the present invention.
Figure 5B:
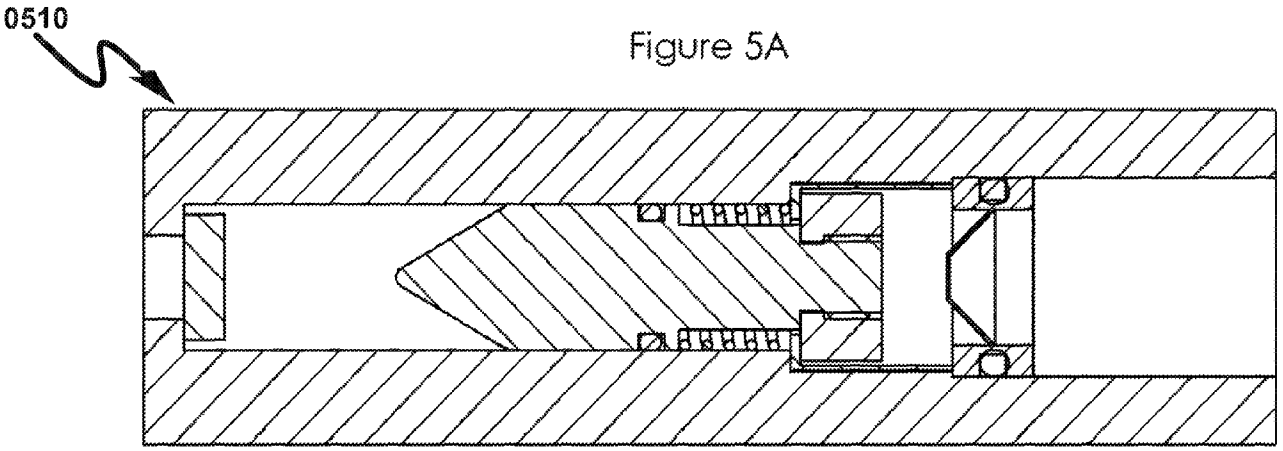
Figure 5C:
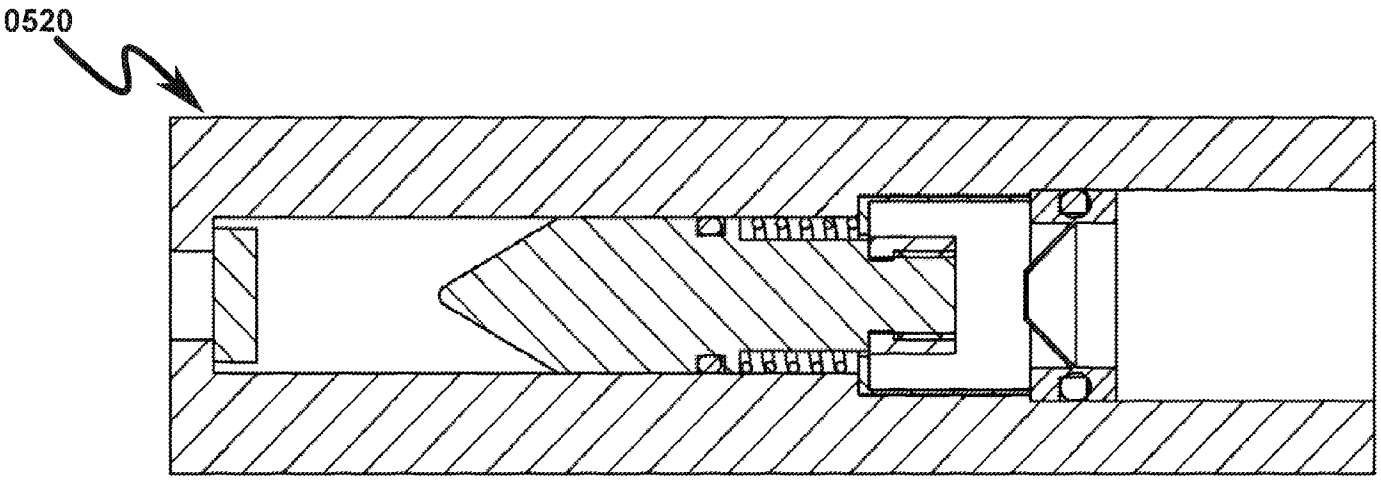
Figure 5D:
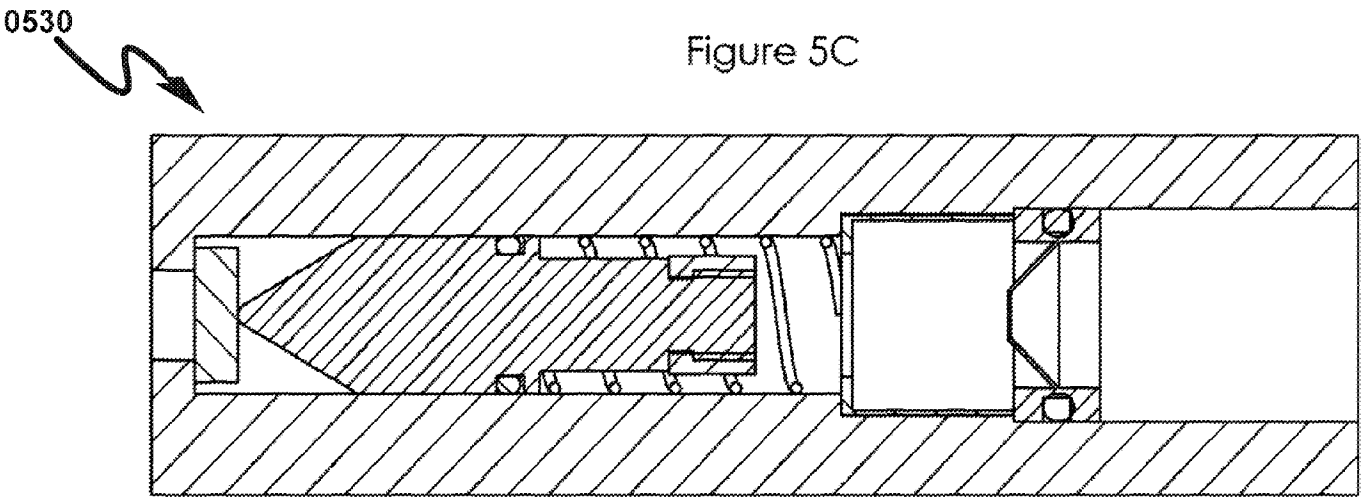
Figure 6:
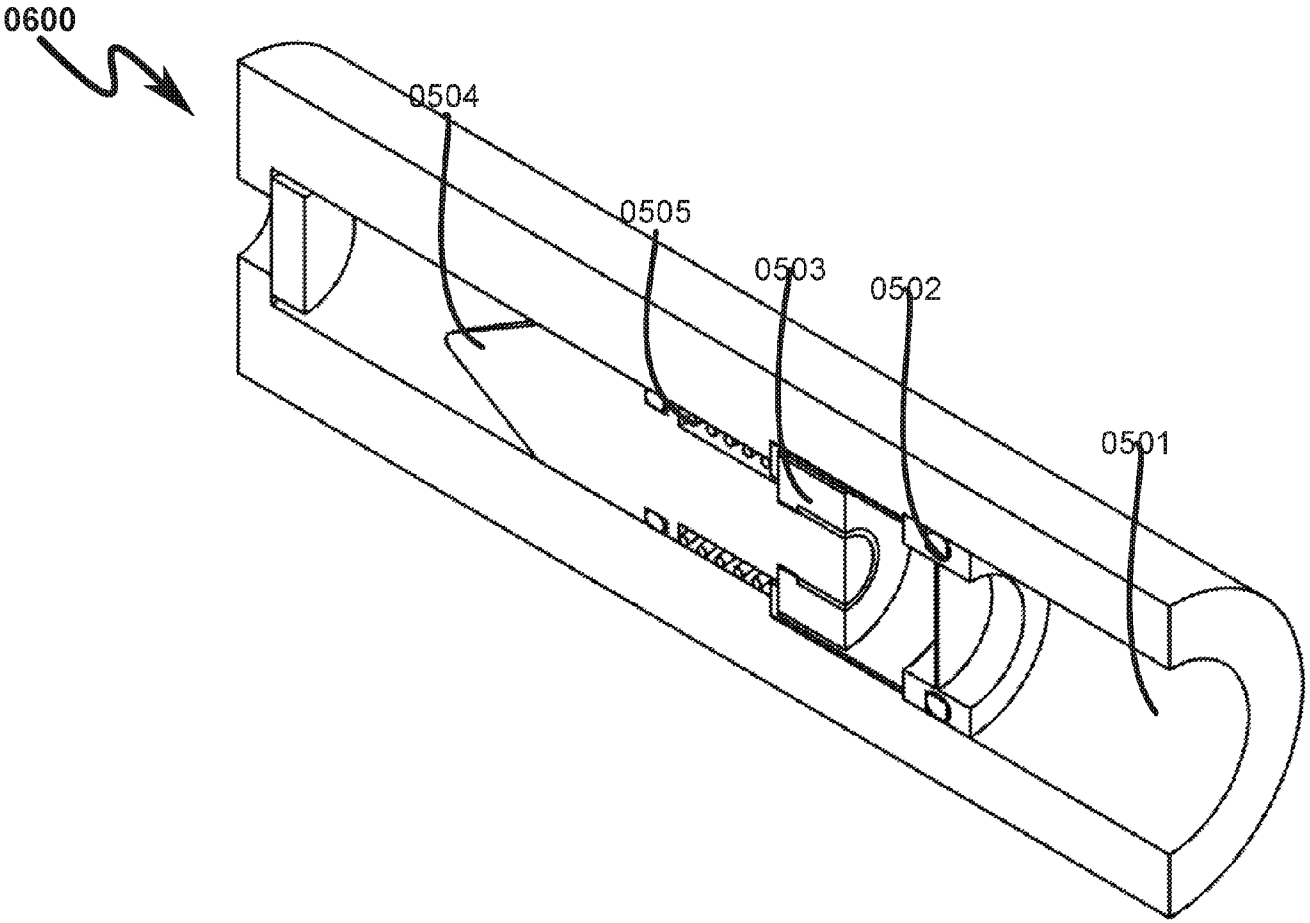
FIG. 6 illustrates a perspective view of a downhole wellbore time delay tool with an energetic device and a firing pin and a spring loaded device according to an exemplary embodiment of the present invention.

Similar to FIGS. 3A-3D, a downhole delay tool with a firing pin and a spring is generally illustrated in FIGS. 5A-5D. As generally illustrated in more detail in FIG. 5A (0500), FIG. 5B (0510), FIG. 5C (0520), FIG. 5D (0530), wherein the downhole wellbore delay tool is deployed inside a wellbore casing. FIG. 5A-5D generally illustrates different positions of a firing pin assembly (0504) restrained by a spring (0505). The positions include an initial set up position (0500), an actuation position (0510), a degradation position (0520) and a triggering position (0530). A detailed view of the tool in the initial set up position is shown in FIG. 5A (0500) wherein the fluid in the reservoir is held by the actuating device (0502). When ready to operate, the pressure is increased for example with TCP. The tool then moves to the actuation position (0510), when pressure acting on the actuating device (0502) exceeds its rated pressure, the actuation device ruptures and enables reactive fluid in the fluid reservoir (0501) to enter the adjacent chamber and contacts the restraining element. Subsequently, after elapse of a pre-determined time delay, the restraining element degrades or changes shape due to the chemical reaction as illustrated in the degradation position in FIG. 5C (0520). In the triggering position (0530), the firing pin (0504) in the energetic device is triggered as the restraining element (0503) no longer holds or restrains the firing pin (0504) and the spring (0505) due to change of shape or a physical property. FIG. 6 (0600) generally illustrates a perspective view of the downhole delay tool with an energetic device and a firing pin and a spring loading mechanism as the wellbore device.

Preferred Exemplary Downhole Wellbore Time Delay Tool Integrated with a Spool Valve (0700-0800)

Figure 7A:
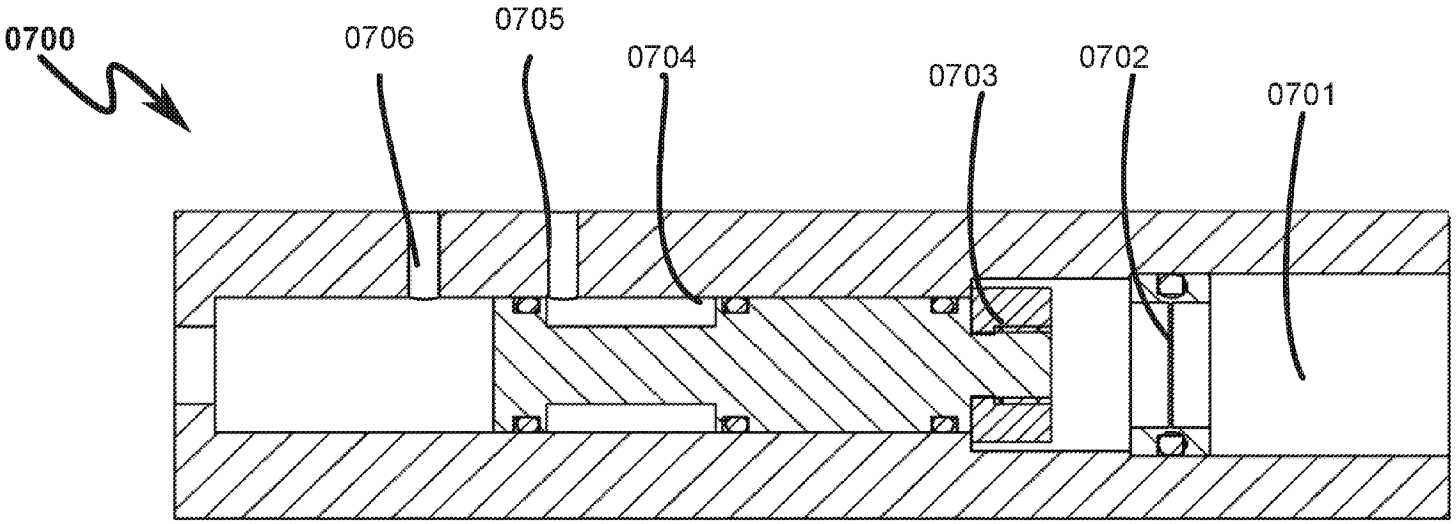
FIG. 7A-7D illustrates a cross-section view of downhole wellbore time delay tool with a spool valve describing an initial set up, actuation position, a degradation position, and a triggering positions according to an exemplary embodiment of the present invention.
Figure 7B:
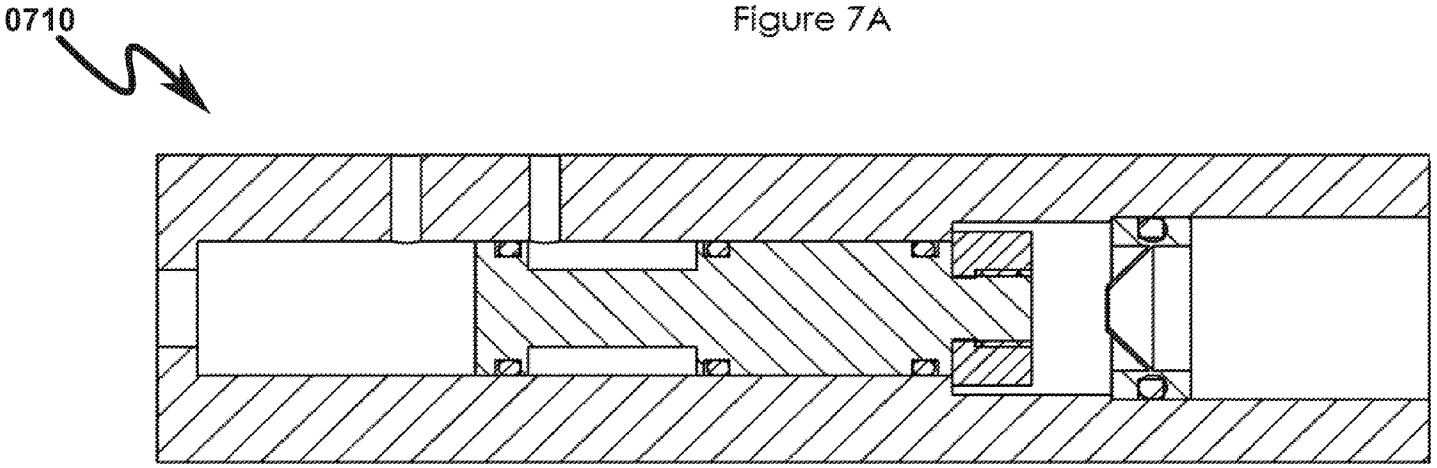
Figure 7C:
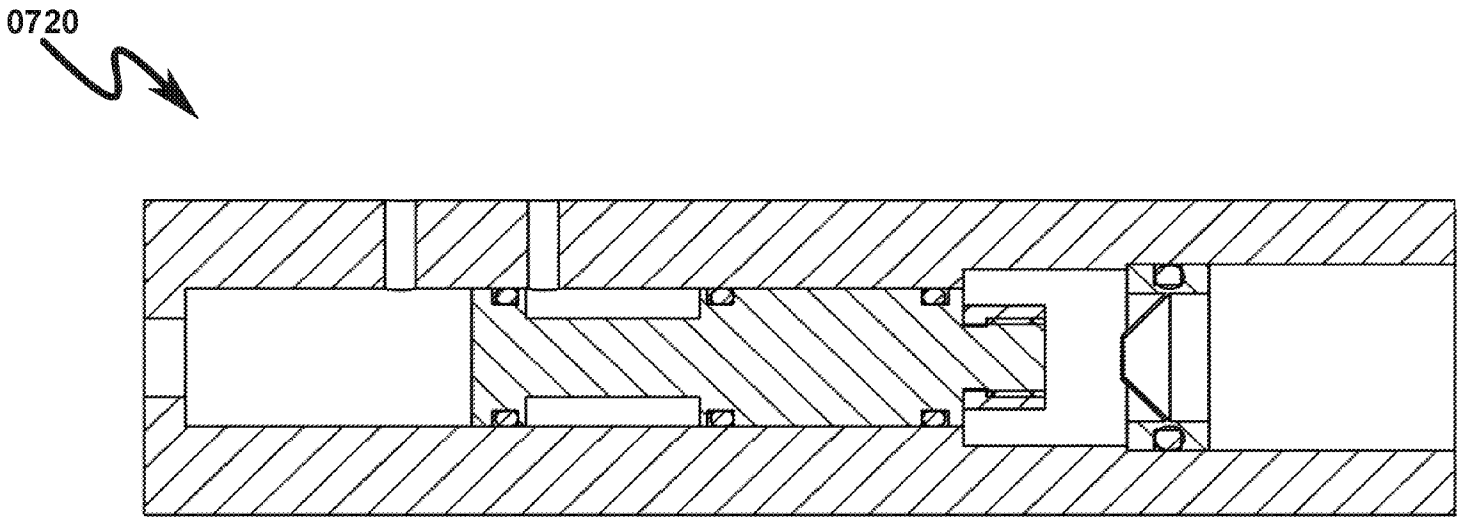
Figure 7D:
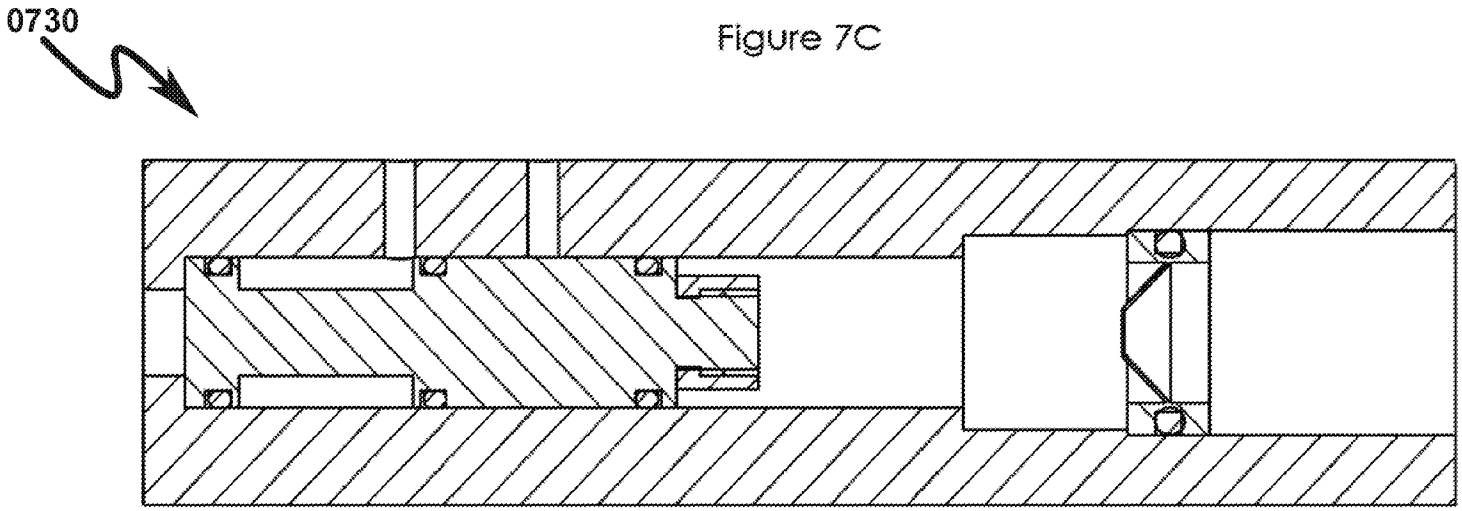
Figures 7E, 7F:
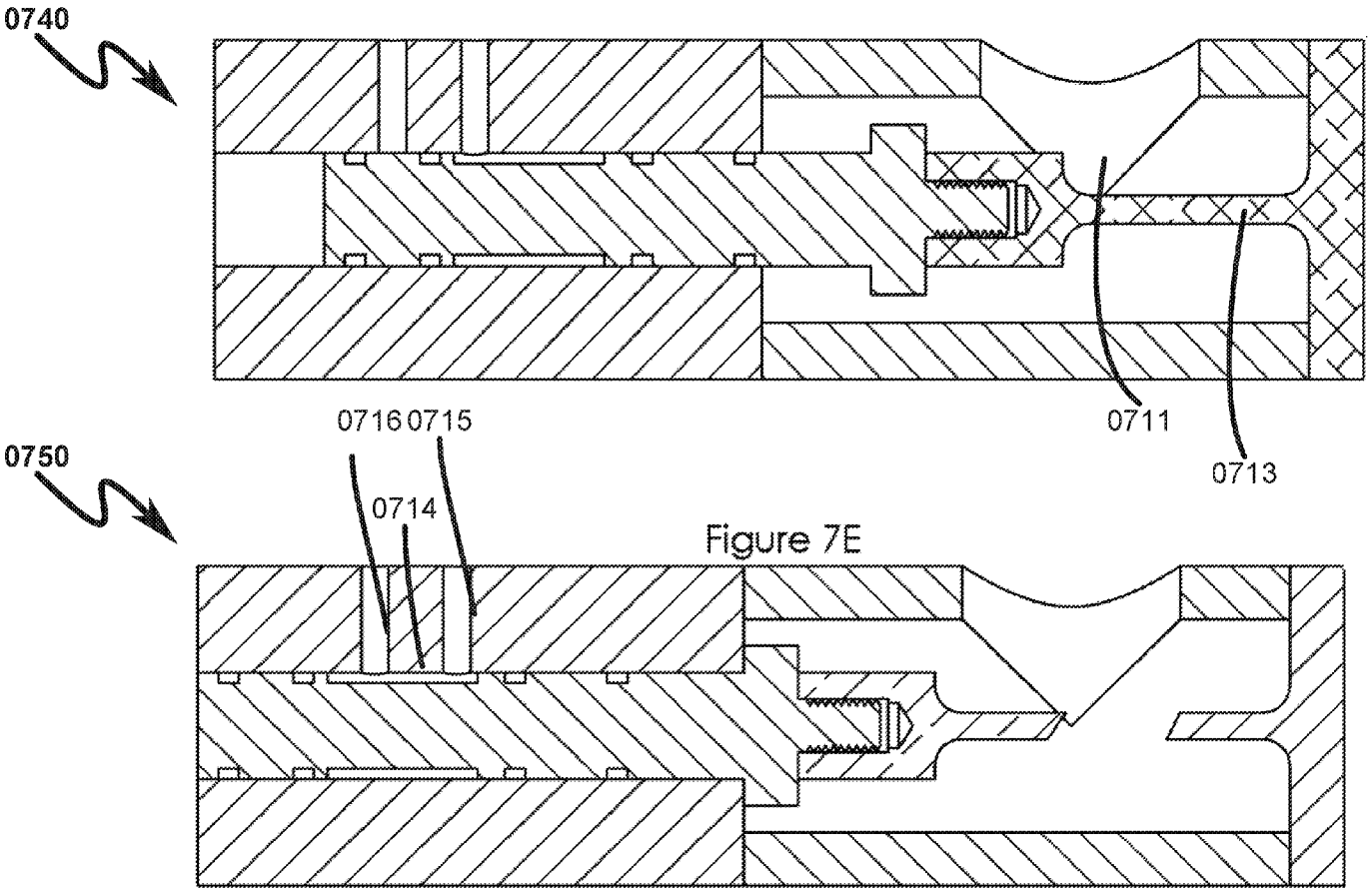
FIG. 7E-7F illustrates a cross-section view of downhole wellbore time delay tool with a spool valve and a tensile member according to an exemplary embodiment of the present invention.
Figure 8:
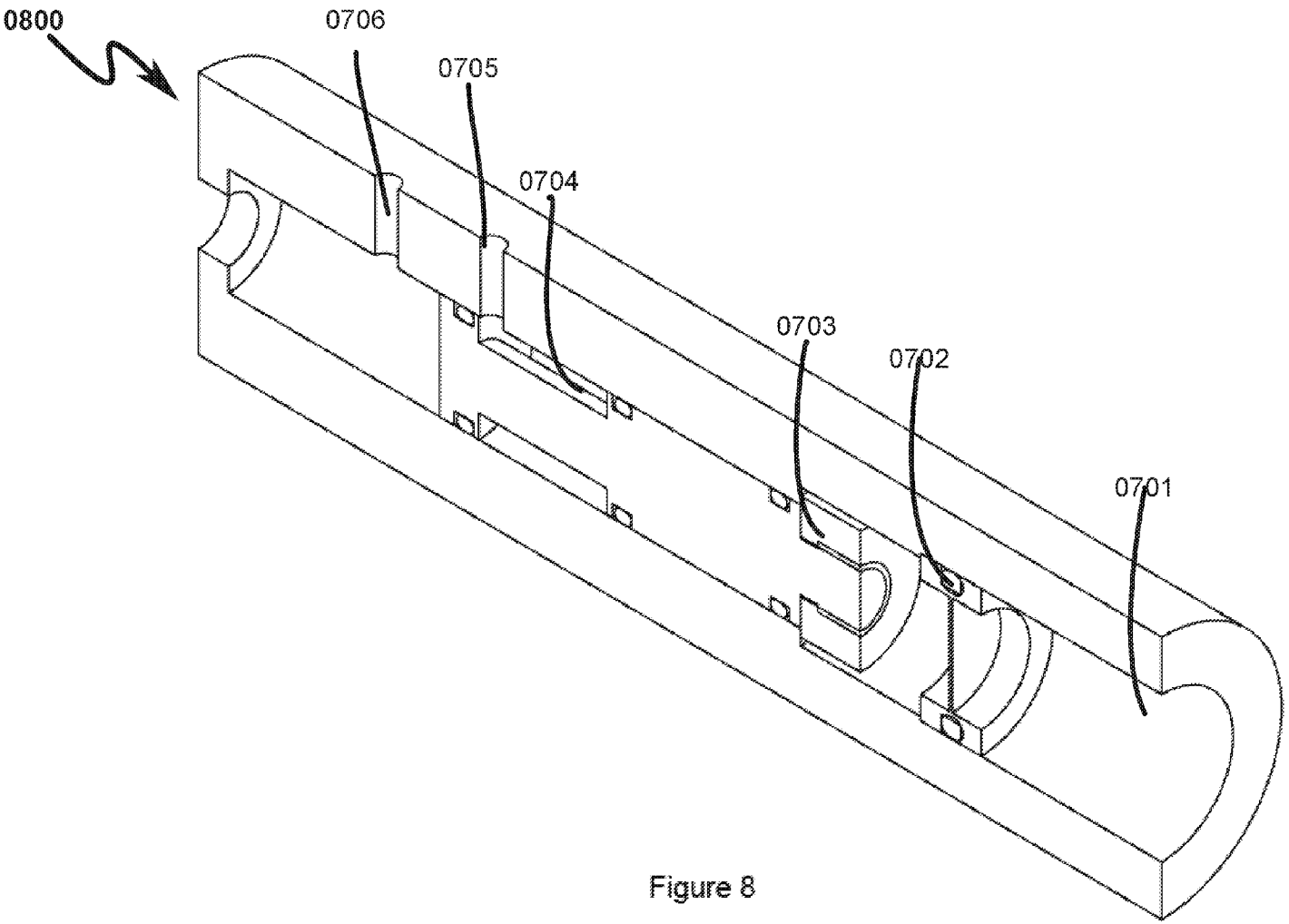
FIG. 8 illustrates a perspective view of a downhole wellbore time delay tool with a spool valve according to an exemplary embodiment of the present invention.

Similar to FIGS. 3A-3D, a downhole delay tool with a spool valve is generally illustrated in FIGS. 7A-7D. A detailed view of the tool in the initial set up position is shown in FIG. 7A (0700) wherein the fluid in the reservoir is held by the actuating device (0702) and a sleeve (0704) may block ports (0705, 0706) and disable pressure or fluid communication to a hydrocarbon formation. When ready to operate, the pressure is increased for example with TCP. The tool then moves to the actuation position (0710), when pressure acting on the actuating device (0702) exceeds its rated pressure, the actuation device ruptures and enables reactive fluid in the fluid reservoir (0701 to enter the adjacent chamber and contacts the restraining element (0703). Subsequently, after elapse of a pre-determined time delay, the restraining element degrades or changes shape due to the chemical reaction as illustrated in the degradation position in FIG. 7C (0720). In the triggering position (0730), a movement in a sleeve (0704) in the spool valve is triggered as the restraining element (0703) no longer holds or restrains the sleeve (0704) due to change of shape. After being released from the restraining element, the sleeve (0704) may slide and unblock one or more ports (0705, 0706) and enable pressure or fluid communication to a hydrocarbon formation. Similar to the mechanical restraining element (0703) in FIG. 7A (0700), a tensile member (0713) is generally illustrated in FIG. 7E (0740). The tensile member (0713) may react with a reactive fluid from a reservoir (0711) and provide a time delay for the tensile member (0713) to break and enable a sleeve in the spool valve to slide and open ports (0714, 0715). FIG. 7F (0750) generally illustrates a sleeve position after the ports (0714, 0715) are opened to the hydrocarbon formation. FIG. 8 (0800) generally illustrates a perspective view of the downhole delay tool with a spool valve and a sliding sleeve as a wellbore device.

Preferred Exemplary Downhole Wellbore Time Delay Tool Integrated with a Pin and a Switch (0900-1000)

Figure 9A:
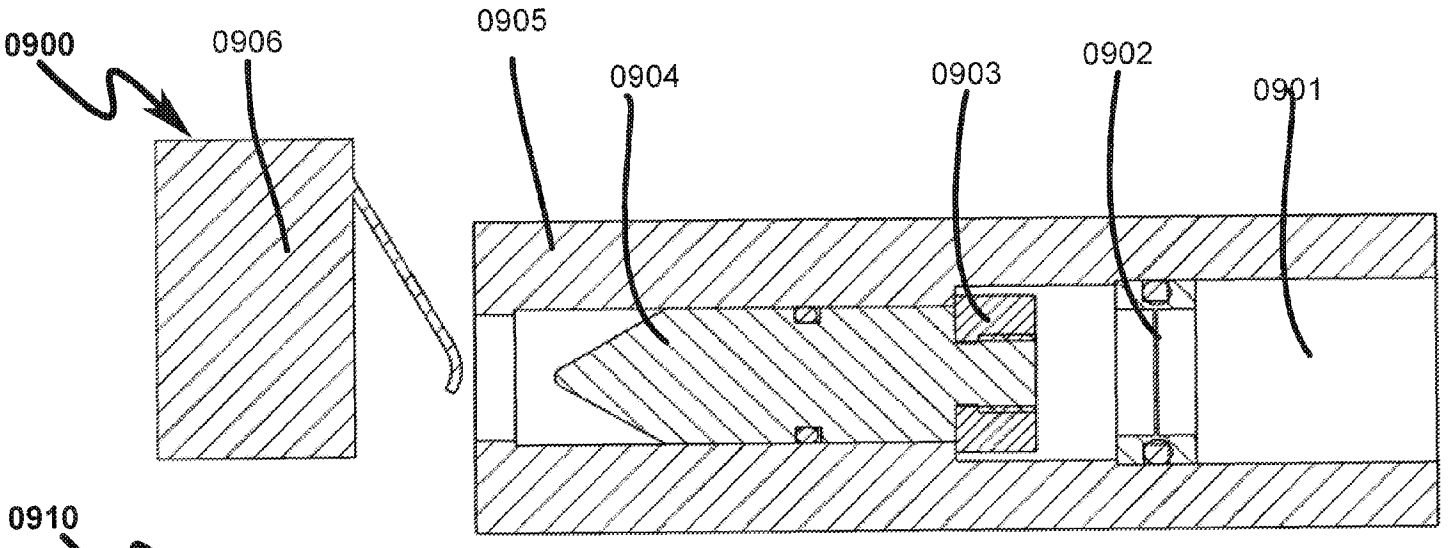
FIG. 9A-9D illustrates a cross-section view of downhole wellbore time delay tool with a firing pin and a switch describing an initial set up, actuation position, a degradation position, and a triggering position according to an exemplary embodiment of the present invention.
Figure 9B:
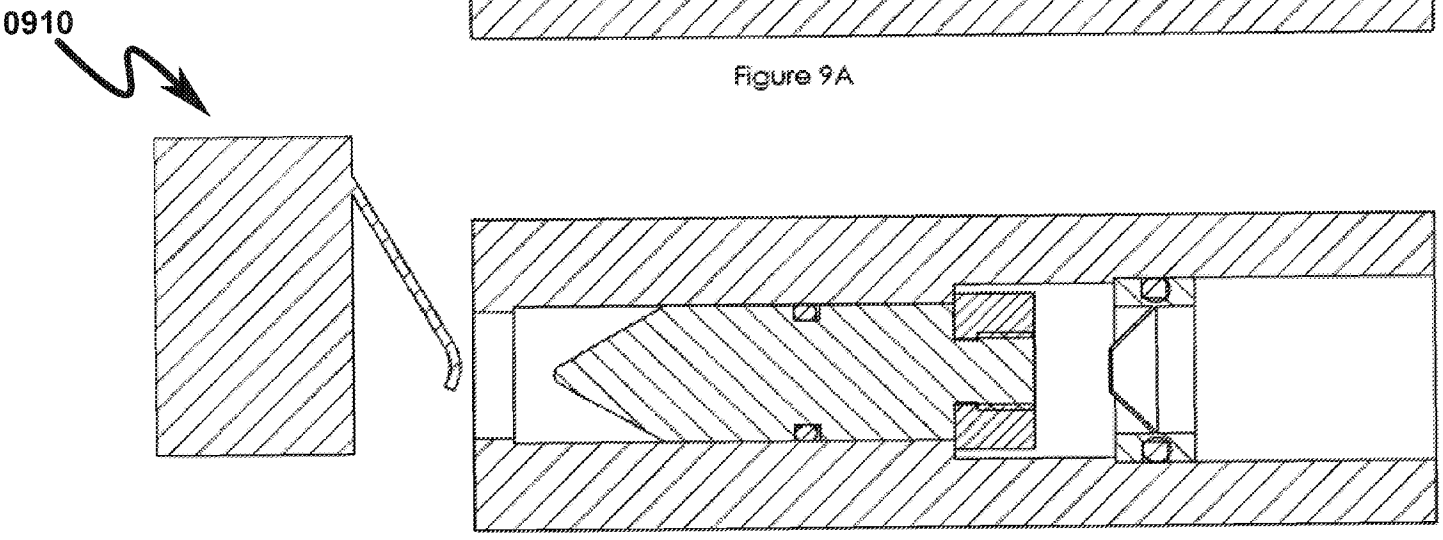
Figure 9C:
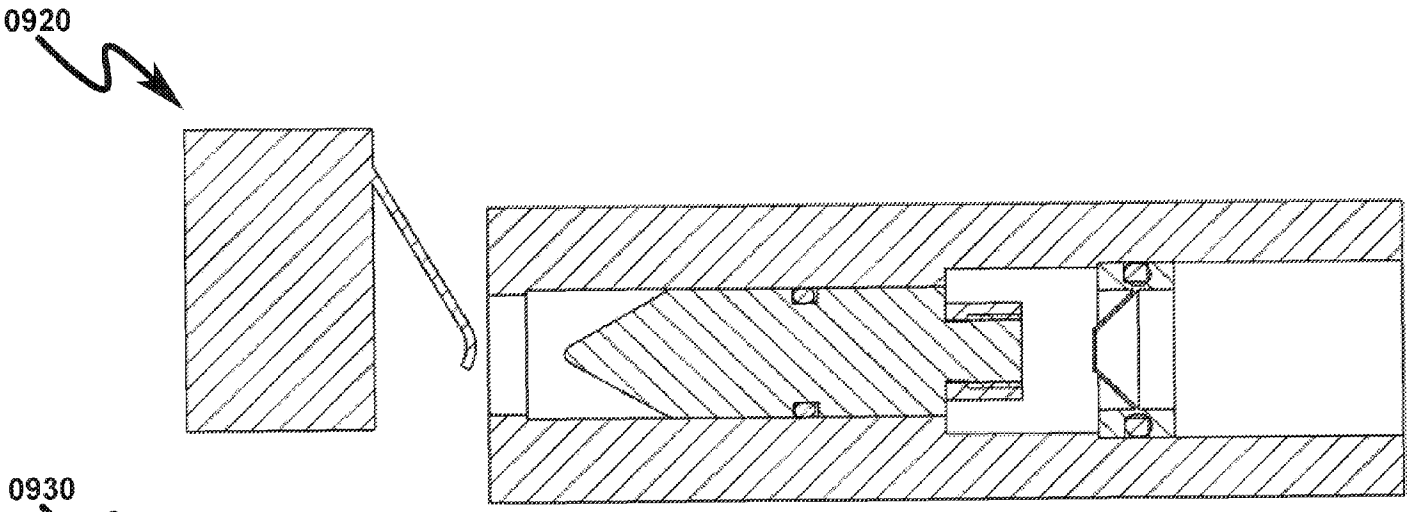
Figure 9D:
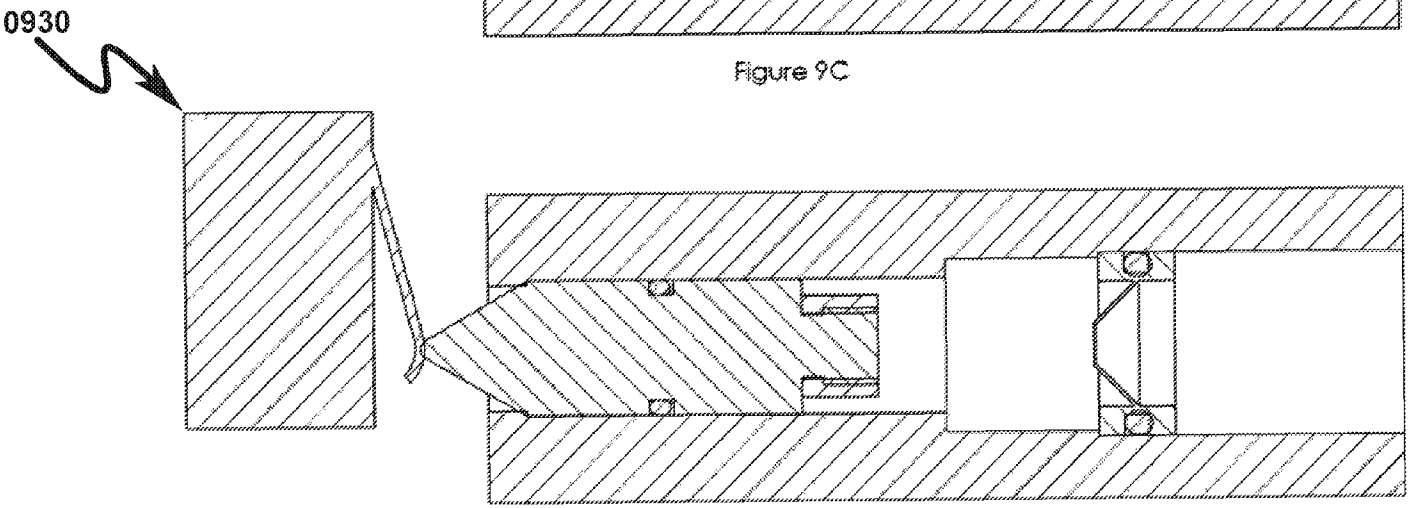
Figure 10:
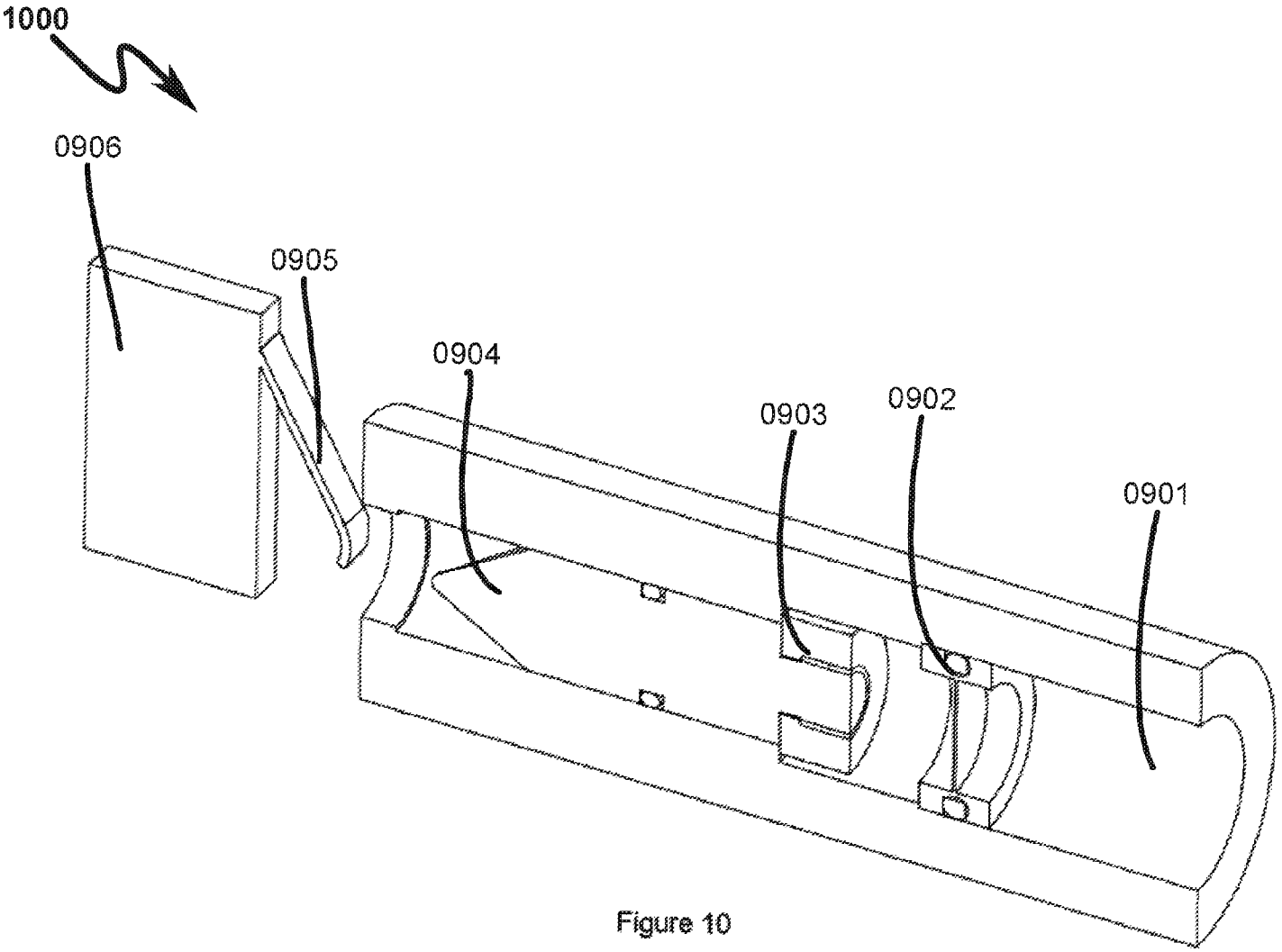
FIG. 10 illustrates a perspective view of a downhole wellbore time delay tool with a firing pin and a switch according to an exemplary embodiment of the present invention.

Similar to FIGS. 3A-3D, a downhole delay tool with a pin and a switch is generally illustrated in FIGS. 9A-9D. As generally illustrated in more detail in FIG. 9A (0900), FIG. 9B (0910), FIG. 9C (0920), FIG. 9D (0930), wherein the downhole wellbore delay tool is deployed inside a wellbore casing. FIG. 9A-9D generally illustrate different positions of a firing pin assembly (0904) and a switch (0906) with a contact (0905). The positions include an initial set up position (0900), an actuation position (0910), a degradation position (0920) and a triggering position (0930). A detailed view of the tool in the initial set up position is shown in FIG. 9A (0900) where in the fluid in the reservoir is held by the actuating device (0902). In the initial set up position (0900), the electrical contact may not be connected to the pin (0904). When ready to operate, the pressure is increased for example with TCP. The tool then moves to the actuation position (0910), when pressure acting on the actuating device (0902) exceeds its rated pressure, the actuation device ruptures and enables reactive fluid in the fluid reservoir (0901) to enter the adjacent chamber and contacts the restraining element (0903). Subsequently, after elapse of a pre-determined time delay, the restraining element degrades or changes shape due to the chemical reaction as illustrated in the degradation position in FIG. 9C (0920). In the triggering position (0930), the pin (0904) in the wellbore device is triggered as the restraining element (0903) no longer holds or restrains the pin (0904) due to change of shape or a physical property. The movement of the pin enables the pin to complete an electrical connection that may be used to trigger an electrical event for purposes of perforating or determining a status. FIG. 10 (1000) generally illustrates a perspective view of the downhole delay tool with a pin and a switch as the wellbore device.

Preferred Exemplary Downhole Wellbore Time Delay Tool Integrated with a Degradable Restriction Element (1100)

Figure 11:
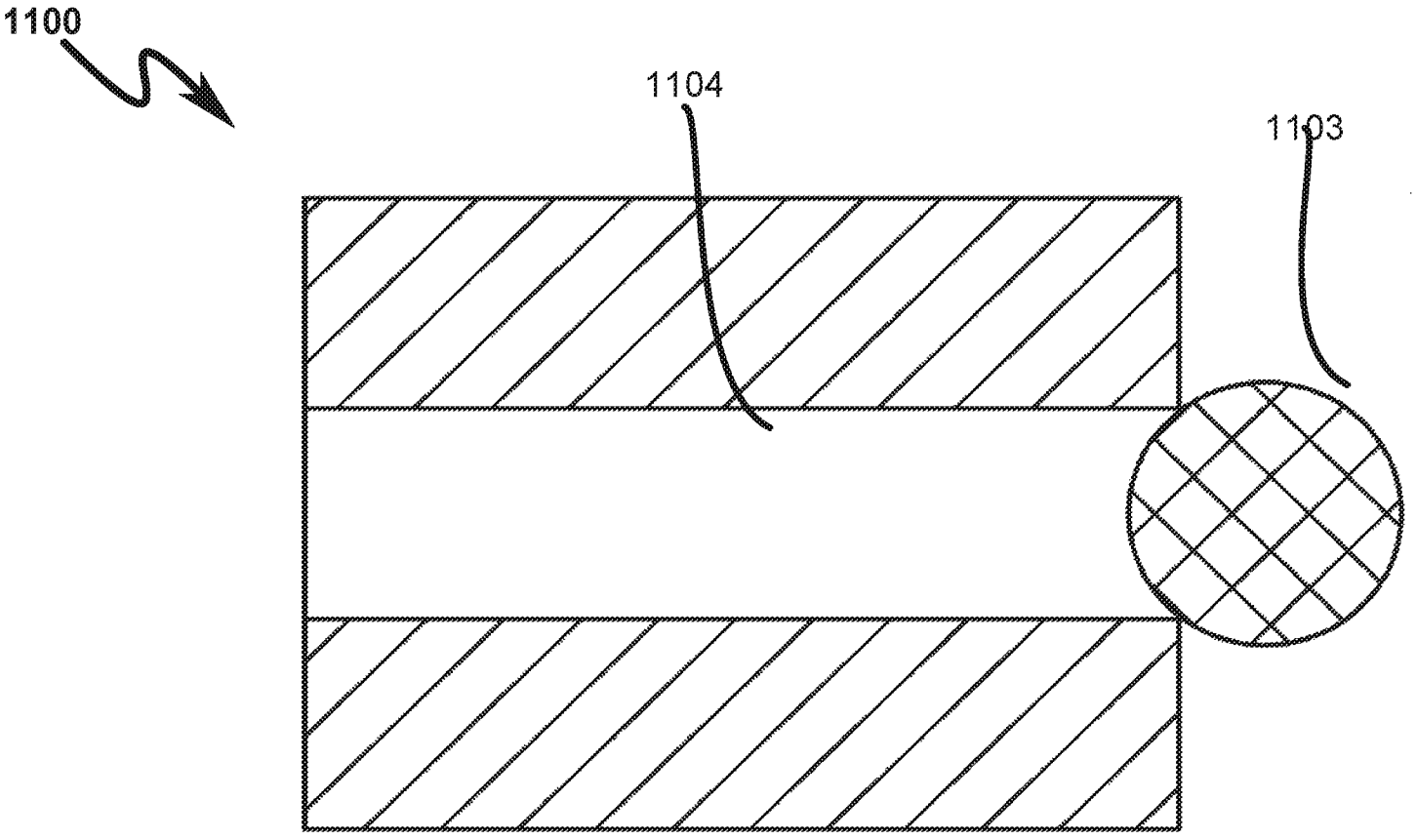
FIG. 11 illustrates a cross section view of a downhole wellbore time delay tool with a dissolvable plug according to an exemplary embodiment of the present invention.

FIG. 11 (1100) generally illustrates a degradable restriction element (1103) blocking a flow channel (1104) in a wellbore casing. A known reactive fluid may be provided to react with the degradable restriction element (1103). After an elapse of a predictable time period, the degradable restriction element (1103) may degrade or change physical shape to enable fluid communication through the channel (1104).

Preferred Exemplary Flowchart Embodiment of a Time Delay Method (1200)

Figure 12:
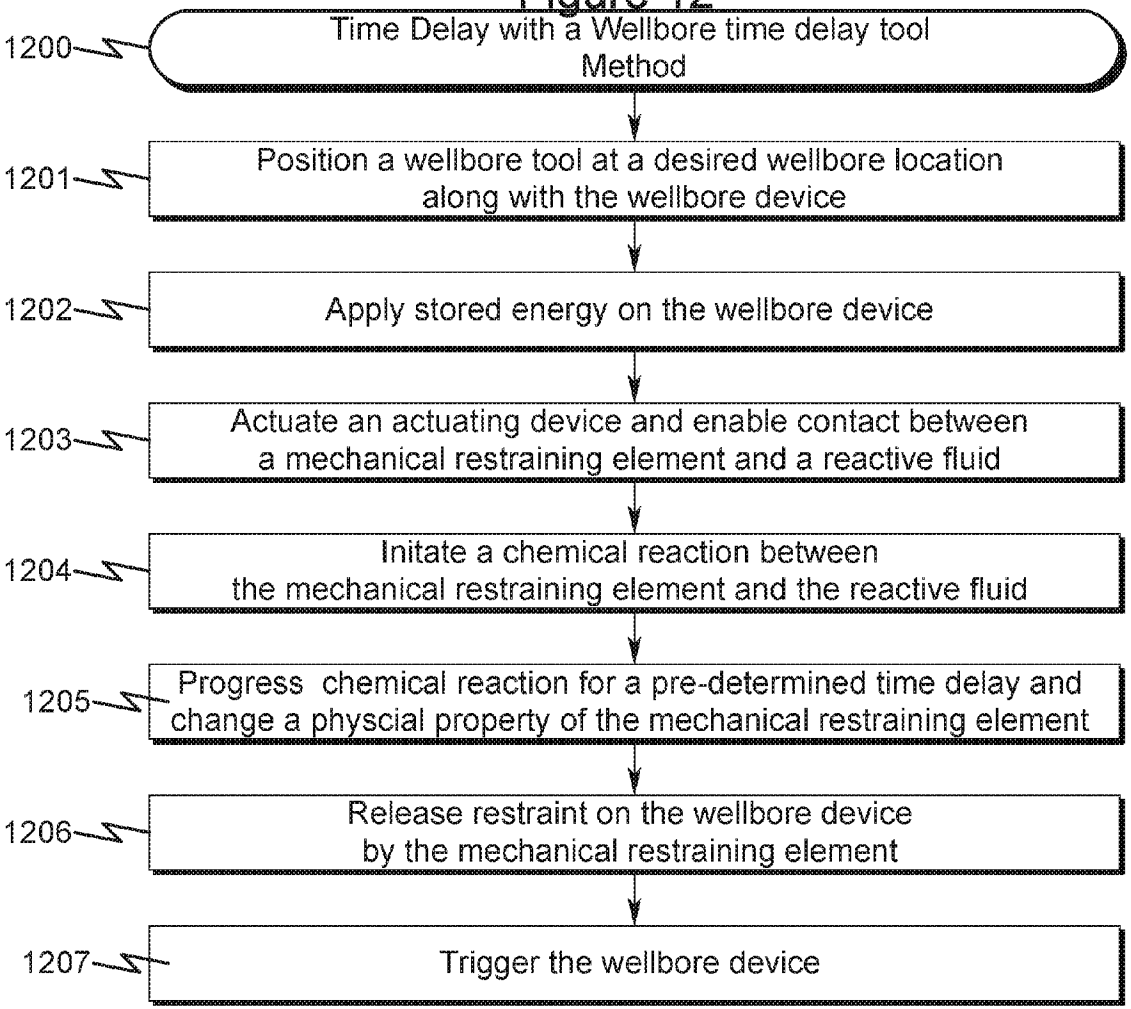
FIG. 12 illustrates an exemplary flow chart for a time delay method operating in conjunction with a downhole wellbore time delay tool according to an embodiment of the present invention.

As generally seen in the flow chart of FIG. 12 (1200), a preferred exemplary flowchart embodiment of a time delay method may be generally described in terms of the following steps:

(1) positioning a wellbore tool at a desired wellbore location (1201);

The entire tool may be piped into the casing string as an integral part of the string and positioned where functioning of the tool is desired or the tool may be deployed to the desired location using TCP, Coiled tubing (CT) or a wire line. The wellbore may be cemented or not. The wellbore tool and the wellbore device may be deployed separately or together.

(2) applying stored energy on the wellbore device (1202);

The stored energy may be applied by pressure and seal, magnetic field, a weight, a spring or combination thereof. The energy may be transferred via TCP or wireline. The stored energy may be directly applied via the restraining element. The stored energy may be applied indirectly via an actuating device and pressure.

(3) actuating the actuating device and enabling contact between the mechanical restraining element and the reactive fluid (1203);

If the differential pressure acting on the piston is greater than a rated pressure of a pressure activated opening device, the device ruptures and allows the piston to move. The rating of the pressure activated device could range from 5000 PSI to 15000 PSI.

(4) initiating a chemical reaction between the mechanical restraining element and the reactive fluid (1204);

According to a preferred exemplary embodiment the pre-determined time delay is determined by composition of the reactive fluids. According to another preferred exemplary embodiment the pre-determined time delay is determined by reaction rate of the reactive fluids with the mechanical restraining element. According to yet another preferred exemplary embodiment the pre-determined time delay is determined by reaction time of the reactive fluids with the mechanical restraining element. According to a further preferred exemplary embodiment the pre-determined time delay is determined by masking a contact area of the mechanical restraining element.

(5) progressing the chemical reaction for a pre-determined time delay and altering size of the mechanical restraining element (1205);

According to a preferred exemplary embodiment, the pre-determined time delay ranges from 1 hour to 48 hours. According to a more preferred exemplary embodiment, the pre-determined time delay ranges from 2 days to 14 days.

According to a most preferred exemplary embodiment, the pre-determined time delay ranges from 0.01 seconds to 1 hour.

(6) releasing restraint on the wellbore device by the mechanical restraining element (1206); and the mechanical restraint may be a nut that decreases in size or loses threads and grip, thereby releasing the wellbore device.

(7) triggering the wellbore device (1207).

The triggering step (7) may move a piston in the wellbore device. The triggering step (7) may open a port in the wellbore device. The triggering step (7) may unplug a wellbore device. The triggering step (7) may enable a rotational movement in the wellbore device.

Preferred Exemplary Flowchart Embodiment of a Time Delay Firing Method (1300)

Figure 13:
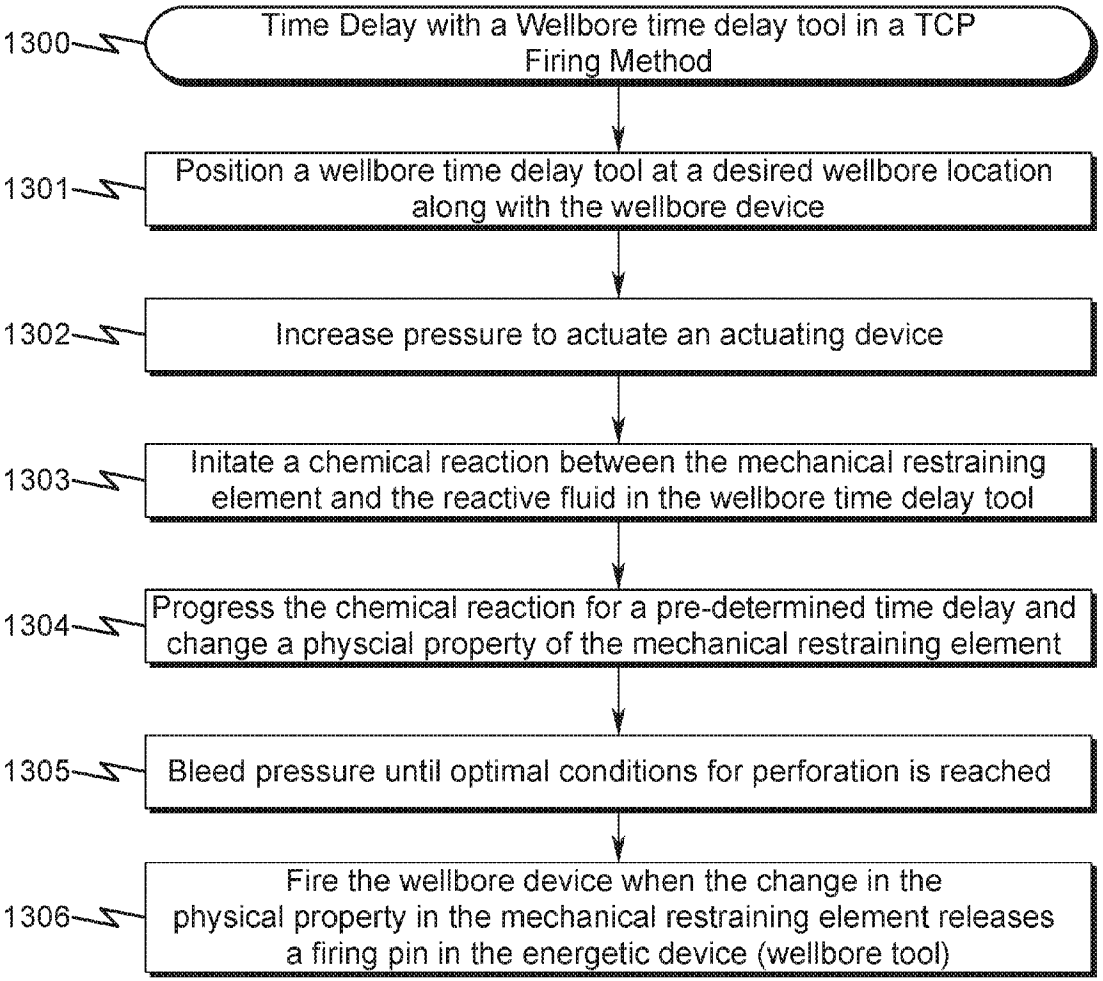
FIG. 13 illustrates a preferred exemplary flowchart embodiment of a time delay firing method in conjunction with a downhole wellbore time delay tool that is integrated into an energetic device used in TCP operation according to an embodiment of the present invention.

As generally seen in the flow chart of FIG. 13 (1300), a preferred exemplary flowchart embodiment of a time delay firing method in conjunction with a downhole wellbore time delay tool; the downhole wellbore time delay tool integrated into an energetic device used in TCP operation may be generally described in terms of the following steps:

(1) positioning a downhole wellbore time delay tool at a desired wellbore location (1301);

The entire tool may be piped into the casing string as an integral part of the string and positioned where functioning of the tool is desired or the tool may be deployed to the desired location using TCP or a wire line. The wellbore may be cemented or not. The downhole wellbore time delay tool may be a tool (0210) as aforementioned in FIG. 2 (0200).

(2) increasing pressure to actuate an actuating device (1302);

The pressure may be applied through TCP or the wellbore pressure may be pumped out until the actuating device such as a rupture disk ruptures.

(3) initiating a chemical reaction between a mechanical restraining element and a reactive fluid in the wellbore time delay tool (1303);

(4) progressing the chemical reaction for a pre-determined time delay and altering physical property of the mechanical restraining element (1304);

According to a preferred exemplary embodiment, the pre-determined time delay ranges from 1 hour to 48 hours. According to a more preferred exemplary embodiment, the pre-determined time delay ranges from 2 days to 14 days.

According to a most preferred exemplary embodiment, the pre-determined time delay ranges from 0.01 seconds to 1 hour.

(5) bleeding pressure until optimal conditions for perforation is reached (1305); and bleeding pressure creates a balanced or an underbalanced condition for perforation.

(6) firing the wellbore device when the change in the physical property in the mechanical restraining element releases a firing pin in the energetic device (1306).

the mechanical restraining element may be a nut that decreases in size or loses threads and grip, thereby releasing the wellbore device. Alternatively, the mechanical restraining element may be a shear pin, a tensile member or a seal.

Preferred Exemplary Time Vs Temperature Reaction Curve Embodiment (1400)

Figure 14:
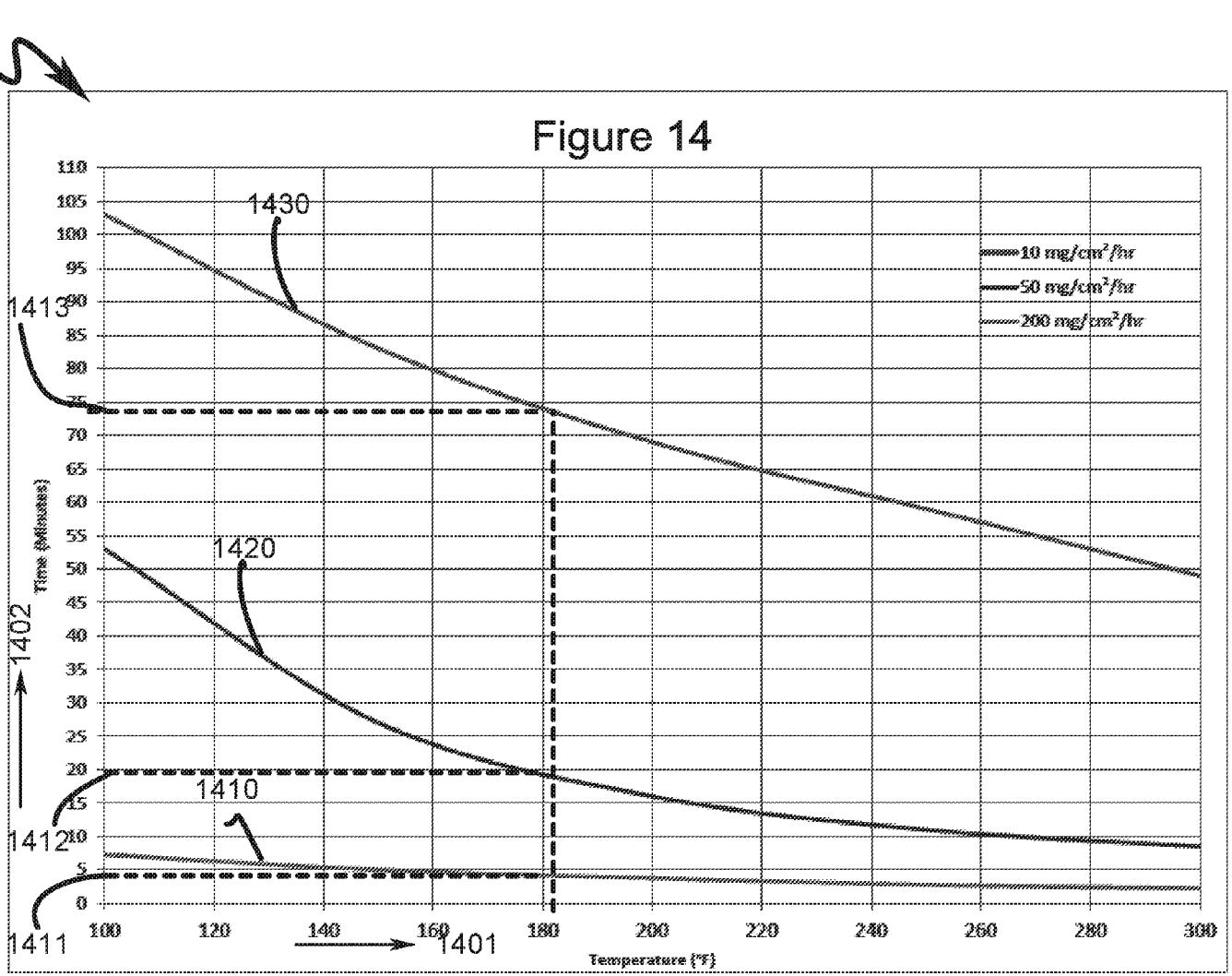
FIG. 14 illustrates an exemplary Time vs Temperature curve for calculating a time delay based on a known fluid and known restraining element according to an embodiment of the present invention.

A time (1401) vs temperature (1402) reaction curve is generally illustrated in FIG. 14 (1400). The nature of the curve depends on the known fluid type reacting with a material of a mechanical restraining element. For example, curve (1410) may represent a fluid type "A" reacting with a material "A" of a mechanical restraining element, curve (1420) may represent a fluid type B reacting with a material "B", and curve (1430) may represent a fluid type "C" reacting with a material "C". The reactive fluid may be a known fluid such as fresh water, salt water, KCL, NaCl, HCL, oil, hydrocarbon or combination thereof. The fluid may be contained in a reservoir (0211) as illustrated in FIG. 2. The mechanical restraining element may be a nut (0203) as illustrated in FIG. 2. The material of the mechanical restraining element may be a metal, a non-metal or an alloy. For example the material of the mechanical restraining element may be Aluminum, Magnesium or an aluminum-Magnesium alloy. A curve may be drawn for each combination of a known fluid and a known material. A model may be developed from the curve in order to calculate a time delay when a temperature is determined in a wellbore. For example, at a temperature of 180° F. the time delay for curve (1410) may be 4 minutes (1411). Similarly, the time delay for curve (1420) may be 20 minutes (1412) and time delay for curve (1430) may be 74 minutes (1413). A model may be developed for each combination of a known fluid and material. The model may be stored and used to determine a time delay when a temperature is determined in a wellbore casing. The predictability of time delay based on a measured temperature enables a triggering event to be delayed reliably with a greater accuracy. Any time delay may be achieved by changing the combination of the reactive fluid and material of the restraining element. The reservoir may be filled with the known fluid, wellbore fluids or a combination thereof. The mechanical restraining element may comprise one or more material types that react and have different degradation rates in one or more fluid types. The desired time delay may be achieved with a combination of fluid types and restraining element material types. The mechanical restraining element may be used in combination with a shear pin mechanism as illustrated in FIG. 3E-3H so that additional control may be provided before a detonator can finally fire. According to a preferred exemplary embodiment, a predictable downhole time delay tool for determining time delay may comprise a known fluid and a known mechanical restraining element wherein the known fluid is configured to react with the mechanical restraining element; and the time delay is determined based upon a condition encountered in the wellbore when the known fluid reacts with the mechanical restraining element. According to another preferred exemplary embodiment, the time delay is further based on a pre-determined reaction curve between the known fluid and the the mechanical restraining element. According to yet another preferred exemplary embodiment, the wellbore condition is wellbore temperature. According to yet another preferred exemplary embodiment, the wellbore temperature is determined by distributed temperature sensing. The known fluid may be wellbore fluids that are sampled and characterized for time delay and temperature. The known fluid may be contained in a reservoir or an open chamber configured to permit fluid to interact with a restraining element.

Preferred Exemplary Flowchart Embodiment of a Time Delay Firing Method (1500)

Figure 15:
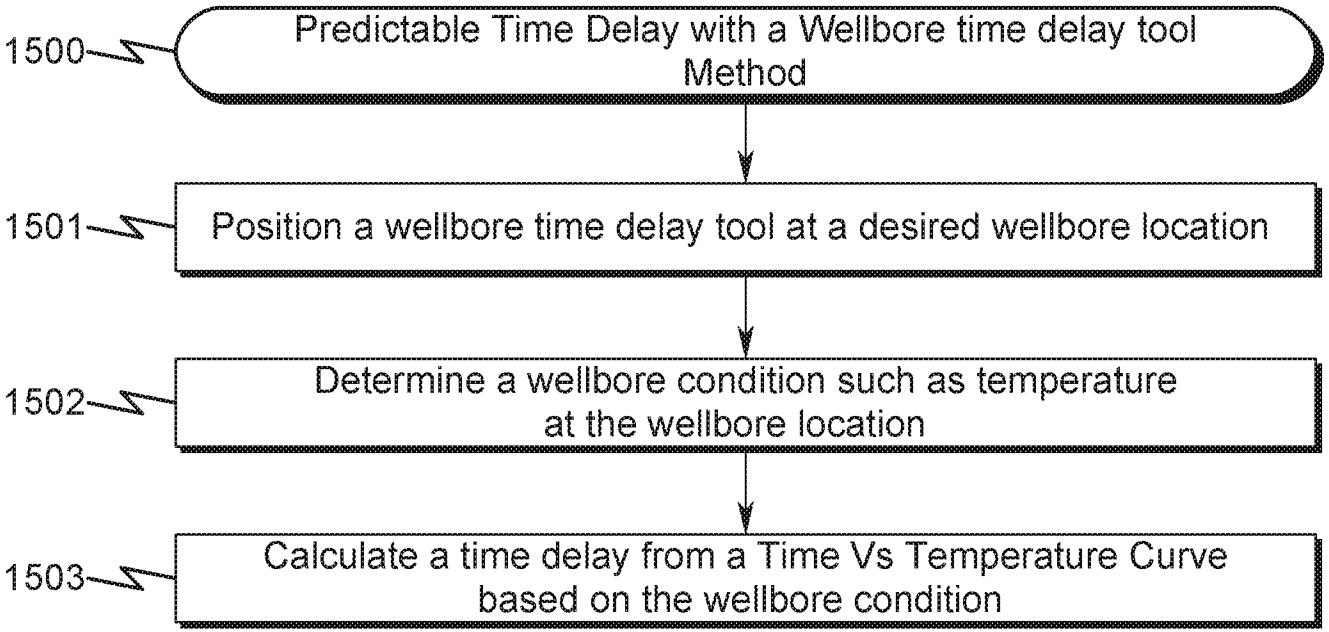
FIG. 15 illustrates an exemplary predictable time delay flowchart operating in conjunction with a predictable downhole time delay tool according to an embodiment of the present invention.

As generally seen in the flow chart of FIG. 15 (1500), a preferred exemplary flowchart embodiment of a predictable time delay method, the method operating in conjunction with a predictable downhole time delay tool comprising a known fluid and a known mechanical restraining element may be generally described in terms of the following steps:

(1) positioning the wellbore time delay tool at a desired wellbore location (1501);

The wellbore time delay tool may be deployed with TCP, CT, a slick line, a wire line or pumped from the surface.

(2) determining a wellbore condition at the wellbore location (1502); and

A wellbore condition such as a temperature may be determined with known methods. For example, a fiber optic cable run with the wellbore casing may be used to determine the temperature. Other wellbore conditions such as wellbore pressure, composition of the wellbore fluids may also be determined using know methods and tools.

(3) calculating a time delay based on the wellbore condition (1503).

A time delay may be calculated with a Time vs Temperature curve as illustrated in FIG. 14 (1400). A triggering event may be initiated in a wellbore device in the wellbore after elapse of the time delay. The triggering event may be the release of a firing pin to initiate a percussion primer to a detonation train. Another trigger event may be unplugging a restriction in a wellbore casing. Yet another triggering event may be sliding a piston to open a port to establish a connection to a hydrocarbon formation.

Preferred Exemplary Detonating Restriction Plug Element (1600)

It is frequently desired to treat hydrocarbon bearing formations with pressurized treatment fluids prior to producing from those formations. In order to ensure that a proper treatment is performed on a desired formation, that formation is typically isolated during treatment from other formations traversed by the wellbore. To achieve sequential treatment of multiple formations, the casing adjacent to the toe of a horizontal, vertical, or deviated wellbore is first perforated while the other portions of the casing are left unperforated. The perforated zone is then treated by pumping fluid under pressure into that zone through perforations. Following treatment a restriction plug element such as element (1600) is placed adjacent to the perforated zone. The process is repeated until all the zones are perforated. The plugs/elements are particularly useful in accomplishing operations such as isolating perforations in one portion of a well from perforations in another portion or for isolating the bottom of a well from a wellhead. The purpose of the plug is to isolate some portion of the well from another portion of the well. In order to reestablish flow past the existing plugs, in present systems an operator must remove and/or destroy the plugs by milling, drilling, or dissolving the plugs. According to a preferred exemplary embodiment the restriction plug element comprising a detonating assembly may detonate after the treatment step. Therefore, the milling or plug removal step may be completely eliminated.

Figure 16A:
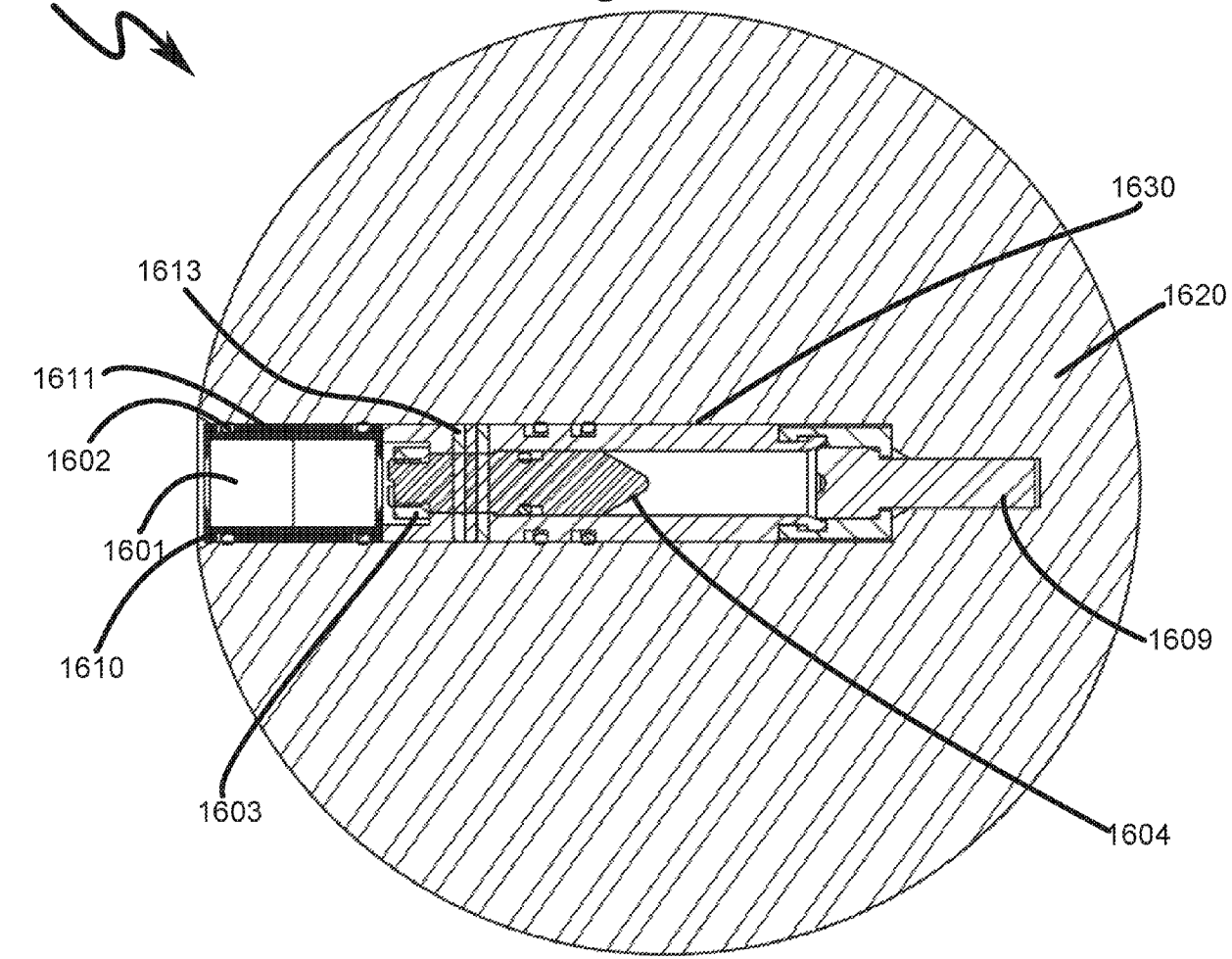
FIG. 16A illustrates a cross section view of a detonating restriction plug element with a detonating assembly according to an exemplary embodiment of the present invention.
Figure 16B:
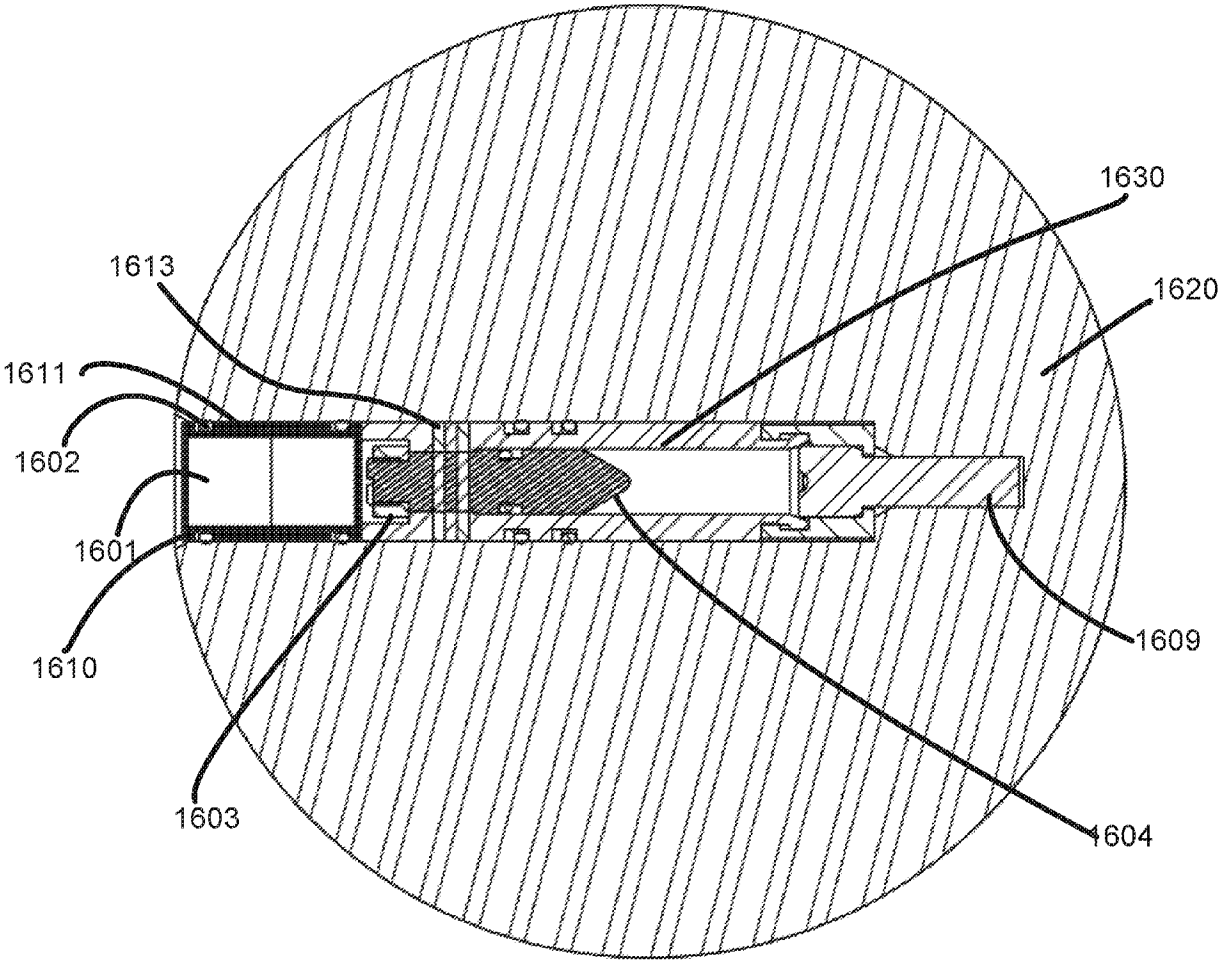
FIG. 16B illustrates another cross section view of a detonating restriction plug element with a detonating assembly according to an exemplary embodiment of the present invention.

As generally illustrated in FIG. 16A and FIG. 16B, a detonating restriction plug element (1600) for isolating stages in a wellbore casing may comprise a body (1620) of degradable material. The restriction plug element may be configured with a hollow passage by drilling a cavity into the degradable element body (1620). The hollow passage may be configured to receive a detonating assembly (1630) that may comprise a detonating device coupled to a mechanical restraining element (1603). The mechanical restraining element (1603) is chosen such that it reacts with a reactive fluid (1601) and the mechanical restraining element (1603) also restrains a firing pin (1604) in the detonating device. The reactive fluid (1601) may come into contact with the mechanical restraining element (1603) and initiate a chemical reaction and that reaction enables a physical property change in the mechanical restraining element (1603) for a pre-determined time delay. The firing pin (1604) initiates a detonating event after elapse of the pre-determined time delay. In other cases the firing pin may initiate a detonating event just before the elapse of the pre-determined time delay. The reactive fluid (1601) may be contained in a reservoir (1611) or a space confined within the detonating assembly (1630). The reactive fluid may be pre-filled in the reservoir (1611) or wellbore fluids may enter the space after the restriction plug element (1600) is deployed into the wellbore casing. The hollow passage may be machined in the body (1620) to receive the detonating assembly (1630) and capped with a seal (1610).

The restriction plug element (1600) may be dropped or pumped into the casing string to a desired location where isolation is required. The wellbore may be cemented or not. The fluid in the reservoir (1611) may be held at an initial position by the actuating device (1602) such as a rupture disk. The tool mandrel is machined to accept the actuating device (1602) (such as rupture discs) that ultimately controls the flow of reactive fluid (1601). The fluid reservoir (1611) may be further installed within a fluid holding body. In one embodiment, the rated pressure of the actuating device may range from 500 PSI to 15000 PSI.

The reservoir (1611) may be in fluid communication with the mechanical restraining element via the actuation device (1602). Alternatively, the reactive fluid may be directly in fluid communication with the mechanical restraining element via the actuation device (1602) without a reservoir. For example, the mechanical restraining element may not be in fluid communication initially with any fluid. Instead, the reactive fluid may be directly in fluid communication with the mechanical restraining element without an actuation device. When the pressure in the wellbore casing increases to actuate the actuating device, wellbore fluids may enter and react with the mechanical restraining element. It should be noted that the reservoir to contain a reactive fluid may not be construed as a limitation. The volume of the reservoir may range from 25 ml to 100 ml. According to a preferred exemplary embodiment, the material of the reservoir may be selected from a group comprising: metal, ceramic, plastic, degradable, long term degradable, glass, composite or combinations thereof. The reservoir may also be pressurized so that there is sufficient flow of the reactive fluid towards the restraining element. The actuation device (1602) may be a reverse acting rupture disk that blocks fluid communication between the reactive fluid and the restraining element. When the pressure of the fluid acting on the actuation device (1602) exceeds a rated pressure of the actuating device (1602), the reactive fluid (1601) may flow through and comes in contact with the restraining element (1603).

The pressure on the actuation device (1602) may be ramped up to the rated pressure with pressure from the reactive fluid. The reactive fluid (1601) is configured to react with the mechanical restraining element (1603) at a temperature expected to be encountered in the wellbore. According to a preferred exemplary embodiment a physical property change in the restraining element may occur at a pre-determined temperature expected to be encountered in the wellbore casing. According to a further preferred exemplary embodiment the pre-determined temperature ranges from 25° C.-250° C. The mechanical restraining element (1603) may be a nut, a shear pin, a tensile member, or a holding device that degrades as the reaction takes place. Upon further degradation, the mechanical restraining element (1603) may release a restraint on the firing pin (1604) and initiate a detonating event in the detonator (1609).

According to a preferred exemplary embodiment the reactive fluid is selected from a group comprising: fresh water, salt water, KCL, NaCl, HCL, or hydrocarbons.

The detonator (1609) and the firing pin (1604) may be operatively connected to the mechanical restraining element (1603) via threads, seals (1613) or a connecting element. In some instances, the mechanical restraining element may be a nut that may be screwed or attached to a counterpart in the detonating assembly. In other instances the restraining element may be a tensile member.

According to a preferred exemplary embodiment, a physical property change due to a chemical reaction may enable the restraining element to change shape for a pre-determined period of time. The physical property may be strength, ductility or elasticity. A delay means, to move a firing pin holder out of locking engagement with a firing pin to release the firing pin and may be achieved by the predetermined time interval. The firing pin (1604) may contact a percussion detonator/initiator that may connect to a bidirectional booster. The bidirectional booster may accept a detonation input from the detonator (1609). The detonating cord may be initiated in turn by the booster. When the firing pin (1604) is actuated after the mechanical restraint (1603) is released, the firing pin (1604) may contact a percussion detonator and in turn initiate a detonator (1609) through a booster and a detonating cord.

According to a preferred exemplary embodiment, the pre-determined time delay ranges from 1 hour to 48 hours. According to a more preferred exemplary embodiment, the pre-determined time delay ranges from 2 days to 14 days. According to a most preferred exemplary embodiment, the pre-determined time delay ranges from 0.01 seconds to 1 hour.

According to a preferred exemplary embodiment, the chemical reaction may be an exothermic reaction that gives off heat. The energy needed to initiate the chemical reaction may be less than the energy that is subsequently released by the chemical reaction. According to another preferred exemplary embodiment, the chemical reaction may be an endothermic reaction that absorbs heat. The energy needed to initiate the chemical reaction may be greater than the energy that is subsequently released by the chemical reaction.

The rate of the chemical reaction may be accelerated or retarded based on factors such as nature of the reactants, particle size of the reactants, concentration of the reactants, pressure of the reactants, temperature and catalysts. According to a preferred exemplary embodiment, a catalyst may be added to alter the rate of the reaction. According to a preferred exemplary embodiment, the material of the restraining element may be selected from a group comprising: mixture of aluminum, copper sulfate, potassium chlorate, and calcium sulfate, iron, magnesium, steel, plastic, degradable, magnesium-iron alloy, particulate oxide of an alkali or alkaline earth metal and a solid, particulate acid or strongly acid salt, or mixtures thereof. The catalyst may be selected from a group comprising salts. According to a preferred exemplary embodiment, the material of the restraining element may be selected from a group comprising: metal, non-metal or alloy.

According to a preferred exemplary embodiment the pre-determined time delay is determined by concentration of the reactive fluids. According to another preferred exemplary embodiment the pre-determined time delay is determined by reaction rate of the reactive fluids with the mechanical restraining element. According to yet another preferred exemplary embodiment the pre-determined time delay is determined by reaction time of the reactive fluids with the mechanical restraining element. According to a further preferred exemplary embodiment the pre-determined time delay is determined by masking a contact area of the mechanical restraining element. According to a further preferred exemplary embodiment the pre-determined time delay is determined by masking a total area of the mechanical restraining element in contact with the mechanical restraining element.

According to a preferred exemplary embodiment the shape of the mechanical restraining element is selected from a group comprising: square, circle, oval, and elongated.

A sealed cap (1610) may seal the exposed end of the detonating assembly (1630) to keep the detonating assembly in the restriction element. The sealed cap may be shaped to fit the detonating restriction plug element such that the cap and the element form a complete sphere or a cylindrical shape.

According to an alternate preferred embodiment, a multi stage restraining element comprising a blocking member and a restraining member may further increase a time delay. For example, mechanical restraining element (1603) may be coupled with a blocking member that may have a different composition and reaction time with the fluid in the reservoir. The blocking member may react with the fluid for a period of time and may restrict fluid access to the mechanical restraining element for a pre-determined period of time. It should be noted that the multi stage restraining element may not limited to a blocking member and a restraining element. Any number of blocking members and restraining elements may be used in combination to achieve a desired time delay. The reaction times and therefore the time delays of each of the bonding members with the fluid may be characterized at various temperatures expected in the wellbore.

In another preferred exemplary embodiment, the reservoir may be filled with wellbore fluids. For example, the reservoir may be empty when deployed into the wellbore and later filled with wellbore fluids. A time vs temperature chart for the restraining element may be characterized with different compositions of wellbore fluids expected in the wellbore at temperatures expected in the wellbore casing. Alternatively, the fluid reservoir may be partially filled with the known fluid and wellbore fluids may fill the remaining portion of the reservoir. The reservoir may be filled with the known fluid, wellbore fluids or a combination thereof. The mechanical restraining element may comprise one or more material types that react and have different degradation rates in one or more fluid types. The desired time delay may be achieved with a combination of fluid types and restraining element material types.

Figure 16C:
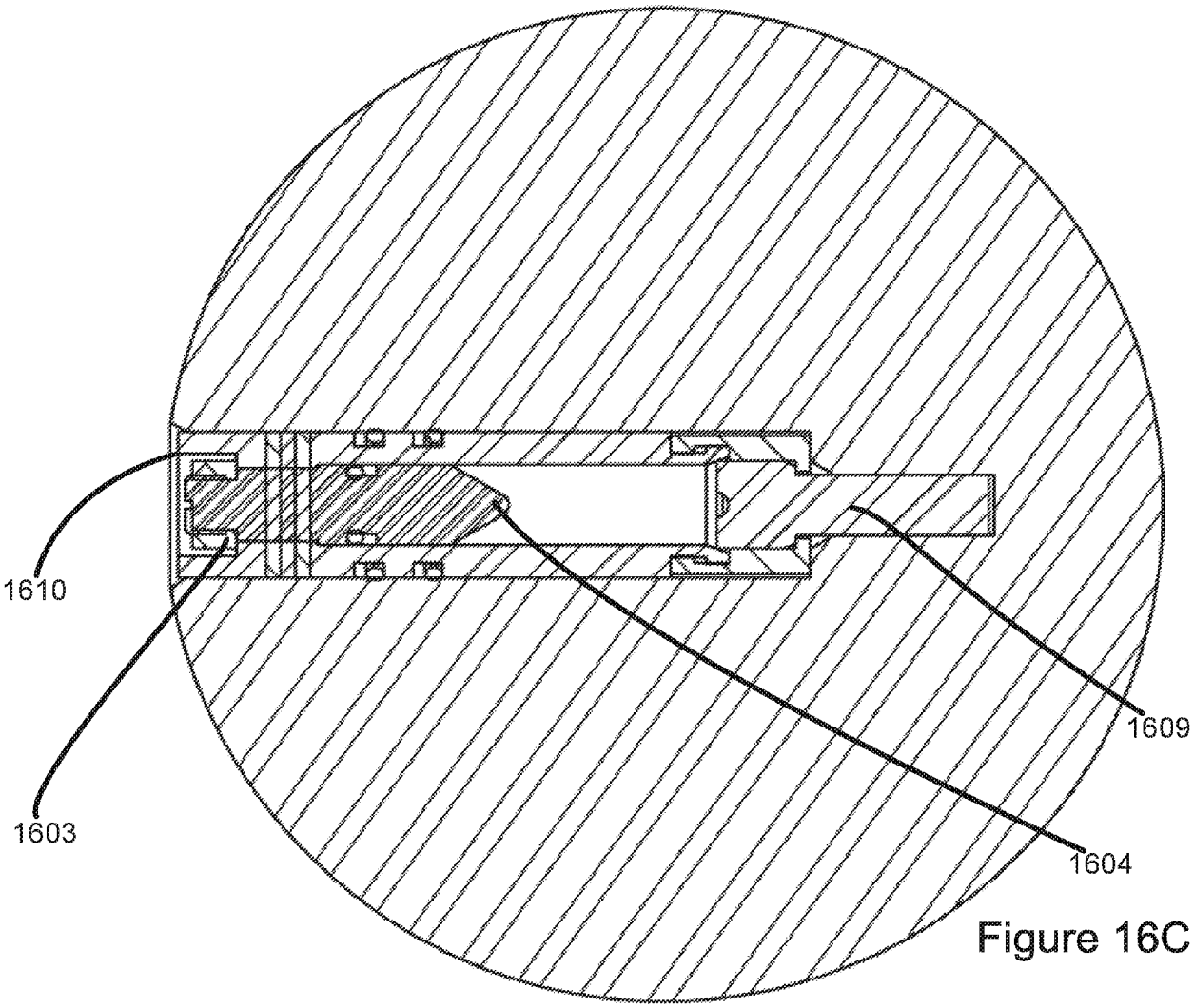
FIG. 16C illustrates a cross section view of a detonating restriction plug element with a detonating assembly without a reservoir and a pressure actuating device according to an exemplary embodiment of the present invention.

As generally illustrated in FIG. 16C a detonating restriction plug element for isolating stages in a wellbore casing may comprise a body of degradable material. The restriction plug element may be configured with a hollow passage by drilling a cavity into the degradable element body. The hollow passage may be configured to receive a detonating assembly that may comprise a detonating device coupled to a mechanical restraining element (1603). The mechanical restraining element (1603) is chosen such that it reacts with a reactive fluid and the mechanical restraining element (1603) also restrains a firing pin (1604) in the detonating device. The reactive fluid may come into contact with the mechanical restraining element (1603) and initiate a chemical reaction and that reaction enables a physical property change in the mechanical restraining element (1603) for a pre-determined time delay. The firing pin (1604) initiates a detonating event after elapse of the pre-determined time delay. In other cases the firing pin may initiate a detonating event just before the elapse of the pre-determined time delay. The reactive fluid may not be held in a reservoir or a chamber as shown in FIG. 16A and FIG. 16B. In a preferred exemplary embodiment, the reactive fluid reacts with the mechanical retaining element without a pressure actuation device. It should be noted that the reactive fluid may be wellbore fluids that come in contact with the mechanical restraining element.

Preferred Exemplary Flowchart Embodiment of a Detonating Method (1700)

Figure 17:
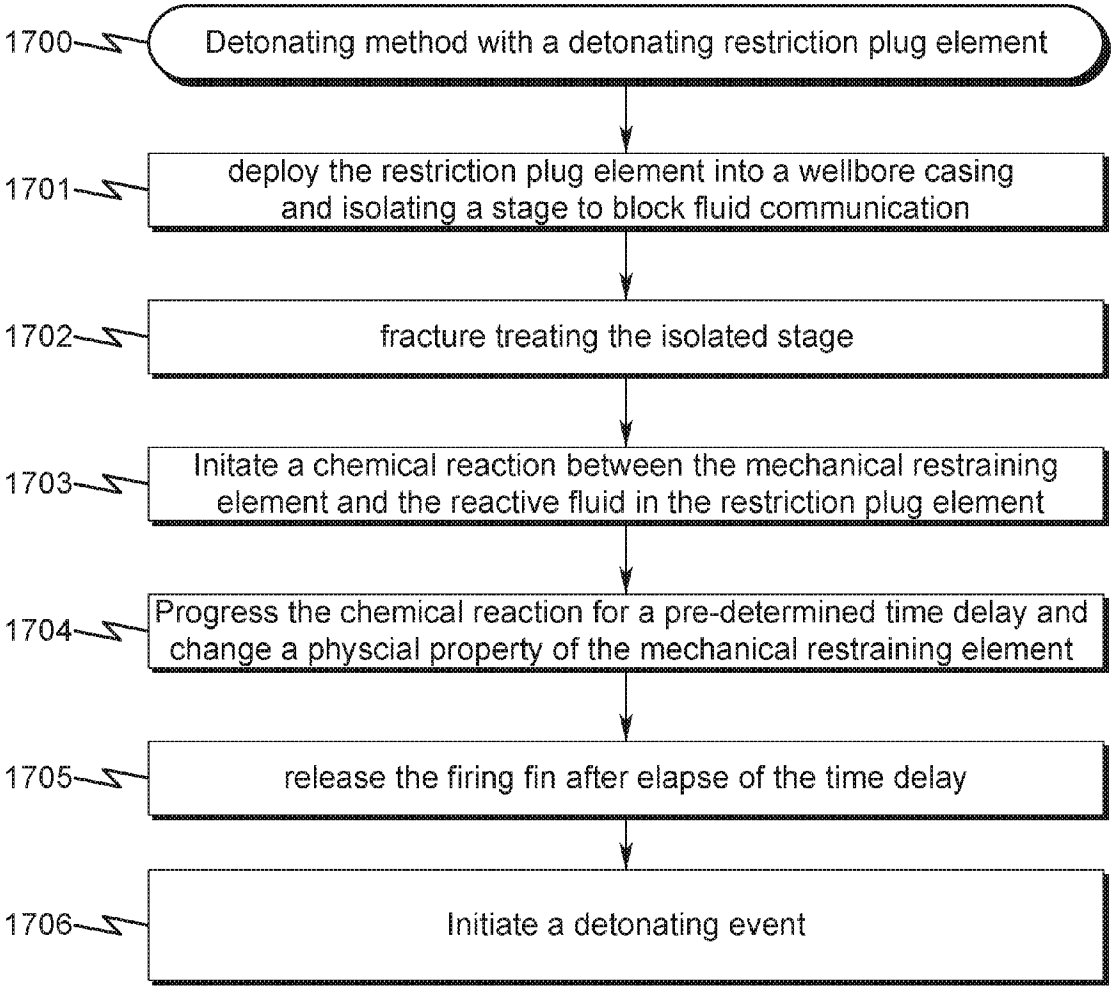
FIG. 17 illustrates a flowchart embodiment of a detonating method operating in conjunction with a detonating restriction plug element according to an exemplary embodiment of the present invention.

As generally seen in the flow chart of FIG. 17 (1700), a preferred exemplary flowchart embodiment of a detonating method operating in conjunction with a detonating restriction plug element (1600) for isolating stages in a wellbore casing may be generally described in terms of the following steps:

(1) Deploying the detonating restriction plug element into the wellbore casing and isolating a stage to block fluid communication (1701);
  The detonating restriction plug element may be pumped or dropped into the wellbore casing to a desired location. The element may seat in a sleeve member or open a sliding sleeve.
(2) Fracturing the stage that was isolated in step (1) (1702);
(3) Initiating a chemical reaction between a mechanical restraining element and a reactive fluid (1703);
(4) Progressing the chemical reaction for a pre-determined time delay and altering physical property of the mechanical restraining element (1704);
  According to a preferred exemplary embodiment, the pre-determined time delay ranges from 1 hour to 48 hours. According to a more preferred exemplary embodiment, the pre-determined time delay ranges from 2 days to 14 days.
  According to a most preferred exemplary embodiment, the pre-determined time delay ranges from 0.01 seconds to 1 hour.
(5) Releasing the firing pin in the detonating assembly after elapse of the pre-determined time delay (1705).
  the mechanical restraining element may be a nut that decreases in size or loses threads and grip, thereby releasing the firing pin. Alternatively, the mechanical restraining element may be a shear pin, a tensile member or a seal.
(6) Initiating a detonating event (1706).
  According to a preferred exemplary embodiment the element fragments after the detonating event.
  According to another preferred exemplary embodiment the hollow passage remains intact while the element further degrades in the wellbore fluids.

According to yet another preferred exemplary embodiment the initiating step is further delayed by a pressure actuating device.

System Summary

The present invention system anticipates a wide variety of variations in the basic theme of time delay, but can be generalized as a downhole wellbore time delay tool for use with a wellbore device in a wellbore casing, comprising:

(a) a mechanical restraining element;

(b) a reactive fluid, the reactive fluid configured to react with the mechanical restraining element;

(c) an actuating device configured to enable fluid communication between the reactive fluid and the mechanical restraining element;

whereby, when a stored energy is applied on the wellbore device, the actuating device actuates and the reactive fluid comes in contact with the mechanical restraining element and initiates a chemical reaction; the chemical reaction enables a physical property change in the mechanical restraining element such that the stored energy applied on the wellbore device is delayed by a pre-determined time delay while the mechanical restraining element undergoes the physical property change.

This general system summary may be augmented by the various elements described herein to produce a wide variety of invention embodiments consistent with this overall design description.

Method Summary

The present invention method anticipates a wide variety of variations in the basic theme of implementation, but can be generalized as a detonating restriction plug element for use with a wellbore device in a wellbore casing wherein the restriction plug element configured with a hollow passage;

the hollow passage configured to receive a detonating assembly;

the detonating assembly comprising a detonating device coupled to a mechanical restraining element;

the mechanical restraining element configured to react with a reactive fluid;

the mechanical restraining element configured to restrain a firing pin in the detonating device (1) deploying the restriction plug element into the wellbore casing and isolating a stage to block fluid communication;

(2) fracturing the stage;

(3) initiating a chemical reaction between the mechanical restraining element and the reactive fluid;

(4) progressing the chemical reaction for a pre-determined time delay and changing a physical property of the mechanical restraining element;

(5) releasing the firing pin after elapse of the time delay; and (6) initiating a detonating event.

This general method summary may be augmented by the various elements described herein to produce a wide variety of invention embodiments consistent with this overall design description.

System/Method Variations

The present invention anticipates a wide variety of variations in the basic theme of oil and gas extraction. The examples presented previously do not represent the entire scope of possible usages. They are meant to cite a few of the almost limitless possibilities.

This basic system and method may be augmented with a variety of ancillary embodiments, including but not limited to:

An embodiment wherein the chemical reaction occurs at a pre-determined temperature expected to be encountered in the wellbore casing.

An embodiment wherein the pre-determined temperature ranges from 25° C.-250° C.

An embodiment wherein the reactive fluid is contained in a reservoir; the reservoir in pressure communication with the mechanical restraining element.

An embodiment wherein the reactive fluid is wellbore fluid expected in the wellbore casing.

An embodiment wherein the reactive fluid is selected from a group comprising: fresh water, salt water, KCL, NaCl, HCL, oil or hydrocarbon.

An embodiment wherein the element fragments after the detonating event.

An embodiment wherein the element remains intact after the detonating event and creates a flow channel.

An embodiment wherein the time delay is determined by a time greater than a fracturing time of an isolated stage.

An embodiment wherein the element is pumped down into the wellbore casing.

An embodiment wherein the time delay ranges from 1 hour to 48 hours.

An embodiment wherein the time delay ranges from 0.01 seconds to 1 hour.

An embodiment wherein the element further comprises a degradable material.

An embodiment wherein the mechanical restraining element is a nut.

An embodiment wherein the mechanical restraining element is a tensile member.

An embodiment wherein the pre-determined time delay is determined by composition of the reactive fluids.

An embodiment wherein the pre-determined time delay is determined by reaction rate of the reactive fluids with the mechanical restraining element.

An embodiment wherein the pre-determined time delay is determined by reaction time of the reactive fluids with the mechanical restraining element.

An embodiment wherein the pre-determined time delay is determined by masking a contact area of the mechanical restraining element.

An embodiment wherein the pre-determined time delay is determined by masking a total area of the mechanical restraining element in contact with the mechanical restraining element.

An embodiment wherein a shape of the mechanical restraining element is selected from a group comprising: square, circle, oval, and elongated.

An embodiment wherein a material of the mechanical restraining element is selected from a group comprising: Magnesium, Aluminum, or Magnesium-Aluminum alloy.

An embodiment wherein the detonating device is a slim detonator.

An embodiment wherein the detonating assembly further comprises a detonating cord coupled to the detonating device.

An embodiment wherein the reactive fluid is pressure isolated from the mechanical restraining element through a pressure actuating device.

An embodiment wherein the actuating device is a rupture disk; the rupture disk actuated by pressure in the wellbore casing.

One skilled in the art will recognize that other embodiments are possible based on combinations of elements taught within the above invention description.

CONCLUSION

A detonating restriction plug element and method in a wellbore casing has been disclosed. The element includes a hollow passage in the restriction plug element that receives a detonating assembly coupled to a mechanical restraining element, and a space for containing a reactive fluid. The mechanical restraining element undergoes a change in shape for a pre-determined time delay due to a chemical reaction when the reactive fluid in the space such as wellbore fluids comes in contact with the restraining element. A firing pin in the detonating assembly is released when the restraining elements changes shape and releases the restraint on the firing pin. The firing pin contacts a detonator in the detonating assembly and causes a detonating event such that the restriction plug element fragments.

What is claimed is:

1. A detonating restriction plug element for isolating stages in a wellbore casing wherein said restriction plug element shaped as a sphere and said restriction plug element configured to be pumped into said wellbore casing without a wireline;

said restriction plug element configured with a hollow passage;

said hollow passage configured to receive a detonating assembly;

said detonating assembly comprising a detonating device coupled to a mechanical restraining element;

said mechanical restraining element configured to react with a reactive liquid;

said mechanical restraining element configured to restrain a firing pin in said detonating device;

wherein, when said reactive fluid comes in contact with said mechanical restraining element and initiates a chemical reaction; said chemical reaction enables a physical property change in said mechanical restraining element for a pre-determined time delay; and said firing pin initiates a detonating event after elapse of said pre-determined time delay.

2. The detonating restriction plug element of claim 1 wherein said chemical reaction occurs at a pre-determined temperature expected to be encountered in said wellbore casing.

3. The detonating restriction plug element of claim 2 wherein said pre-determined temperature ranges from 25° C.-250° C.

4. The detonating restriction plug element of claim 1 wherein said reactive liquid is contained in a reservoir; said reservoir in pressure communication with said mechanical restraining element.

5. The detonating restriction plug element of claim 1 wherein said reactive liquid is wellbore liquid expected in said wellbore casing.

6. The detonating restriction plug element of claim 1 wherein said reactive liquid is selected from a group comprising: fresh water, salt water, KCL, NaCl, HCL, oil or hydrocarbon.

7. The detonating restriction plug element of claim 1 wherein said detonating restriction plug element fragments after said detonating event.

8. The detonating restriction plug element of claim 1 wherein said detonating restriction plug element remains intact after said detonating event and creates a flow channel.

9. The detonating restriction plug element of claim 1 wherein said time delay is determined by a time greater than a fracturing time of an isolated stage.

10. The detonating restriction plug element of claim 1 wherein said time delay ranges from 1 hour to 48 hours.

11. The detonating restriction plug element of claim 1 wherein said time delay ranges from 0.01 seconds to 1 hour.

12. The detonating restriction plug element of claim 1 wherein said detonating restriction plug element further comprises a degradable material.

13. The detonating restriction plug element of claim 1 wherein said mechanical restraining element is a nut.

14. The detonating restriction plug element of claim 1 wherein said mechanical restraining element is a tensile member.

15. The detonating restriction plug element of claim 1 wherein said pre-determined time delay is determined by composition of said reactive liquids.

16. The detonating restriction plug element of claim 1 wherein said pre-determined time delay is determined by reaction rate of said reactive liquids with said mechanical restraining element.

17. The detonating restriction plug element of claim 1 wherein said pre-determined time delay is determined by reaction time of said reactive liquids with said mechanical restraining element.

18. The detonating restriction plug element of claim 1 wherein said pre-determined time delay is determined by masking a contact area of said mechanical restraining element.

19. The detonating restriction plug element of claim 1 wherein said pre-determined time delay is determined by masking a portion of said mechanical restraining element in contact with said reactive liquid.

20. The detonating restriction plug element of claim 1 wherein a shape of said mechanical restraining element is selected from a group comprising: square, circle, oval, and elongated.

21. The detonating restriction plug element of claim 1 wherein a material of said mechanical restraining element is selected from a group comprising: Magnesium, Aluminum, or Magnesium-Aluminum alloy.

22. The detonating restriction plug element of claim 1 wherein said detonating assembly further comprises a detonating cord coupled to said detonating device.

23. The detonating restriction plug element of claim 1 wherein said reactive liquid is pressure isolated from said mechanical restraining element through a pressure actuating device.

24. The detonating restriction plug element of claim 23 wherein said actuating device is a rupture disk; said rupture disk actuated by pressure in said wellbore casing.

25. A detonating method, said method operating in conjunction with a detonating restriction plug element for isolating stages in a wellbore casing, wherein said restriction plug element shaped as a sphere and configured to be pumped into said wellbore casing without a wireline;

said restriction plug element configured with a hollow passage;

said hollow passage configured to receive a detonating assembly;

said detonating assembly comprising a detonating device coupled to a mechanical restraining element;

said mechanical restraining element configured to react with a reactive liquid;

said mechanical restraining element configured to restrain a firing pin in said detonating device;

wherein said method comprises the steps of:

(1) pumping said restriction plug element into said wellbore casing and isolating a stage to block liquid communication;

(2) fracturing said stage;

(3) initiating a chemical reaction between said mechanical restraining element and said reactive liquid;

(4) progressing said chemical reaction for a pre-determined time delay and changing a physical property of said mechanical restraining element;

(5) releasing said firing pin after elapse of said time delay; and (6) initiating a detonating event.

26. The detonating method claim 25 wherein said detonating restriction plug element fragments after said detonating event.

27. The detonating method claim 25 wherein said hollow passage remains intact while said detonating restriction plug element further degrades in said reactive liquids.

28. The detonating method claim 25 wherein said initiating step is further delayed by a pressure actuating device.

* * * * *